US011177597B2

(12) United States Patent
Hashiguchi

(10) Patent No.: US 11,177,597 B2
(45) Date of Patent: Nov. 16, 2021

(54) CONNECTOR ADAPTED TO BE CONNECTED TO FLEXIBLE CONDUCTOR

(71) Applicant: Japan Aviation Electronics Industry, Limited, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/934,834

(22) Filed: Jul. 21, 2020

(65) Prior Publication Data

US 2021/0098914 A1 Apr. 1, 2021

(30) Foreign Application Priority Data

Oct. 1, 2019 (JP) ..... JP2019-181474

(51) Int. Cl.
*H01R 12/77* (2011.01)
*H01R 13/41* (2006.01)

(52) U.S. Cl.
CPC ..... *H01R 12/777* (2013.01); *H01R 12/778* (2013.01); *H01R 13/41* (2013.01)

(58) Field of Classification Search
CPC ..... H01R 12/00; H01R 12/59; H01R 12/592; H01R 12/61; H01R 12/616; H01R 12/65;
(Continued)

(56) References Cited

U.S. PATENT DOCUMENTS 6,394,833 B1 * 5/2002 Bulmer ..... H01R 12/675 439/393
8,465,328 B2 * 6/2013 Iida ..... H01R 12/62 439/660

(Continued)

FOREIGN PATENT DOCUMENTS

JP 2009059586 A * 3/2009
JP 2018129244 A 8/2018

OTHER PUBLICATIONS

English Translation of JP 2009-59586A (Year: 2009).*
Extended European Search Report issued in corresponding EP application No. 20189601.6 dated Nov. 2, 2020 (13 pages).

*Primary Examiner* — Edwin A. Leon
*Assistant Examiner* — Matthew T Dzierzynski
(74) *Attorney, Agent, or Firm* — Muncy, Geissler, Olds & Lowe, P.C.

(57) ABSTRACT

A connector includes a first insulator having a through-hole for contact, a contact held by the first insulator and having a projecting portion inserted into the through-hole for contact, and a receiving member disposed on a side of a second surface of the first insulator and surrounding the projecting portion of the contact, the flexible conductor being disposed along the second surface of the first insulator, the contact including an extending portion formed on another end of the projecting portion and disposed on the side of the second surface of the first insulator to extend outside of the through-hole for contact along the second surface, a part of the flexible conductor being held between the extending portion of the contact and the receiving member to contact the extending portion, whereby the contact is electrically connected to the flexible conductor.

14 Claims, 21 Drawing Sheets

(58) Field of Classification Search
CPC ..... H01R 12/67; H01R 12/68; H01R 12/70; H01R 12/77; H01R 12/777; H01R 12/778
USPC ..... 439/499
See application file for complete search history.

(56) References Cited

U.S. PATENT DOCUMENTS

| | | | | |
|---|---|---|---|---|
| 9,220,163 | B2 * | 12/2015 | Hashiguchi | H05K 1/00 |
| 9,627,804 | B2 * | 4/2017 | Barth | A41D 1/005 |
| 9,859,642 | B2 * | 1/2018 | Hashiguchi | H01R 13/2478 |
| 10,084,276 | B2 * | 9/2018 | Matsuo | H01R 33/965 |
| 10,199,770 | B2 * | 2/2019 | Komoto | H01R 13/74 |
| 2011/0278048 | A1 * | 11/2011 | Numakura | H01R 12/62 174/254 |
| 2017/0112200 | A1 | 4/2017 | Mason et al. | |
| 2018/0233854 | A1 | 8/2018 | Komoto et al. | |
| 2019/0148901 | A1 | 5/2019 | Komoto | |

* cited by examiner

CONNECTOR ADAPTED TO BE CONNECTED TO FLEXIBLE CONDUCTOR

BACKGROUND OF THE INVENTION

The present invention relates to a connector, and, more particularly, relates to a connector connected to a flexible conductor.

As a connector connected to a flexible conductor, for example, JP 2018-129244 A discloses a connector as illustrated in FIG. 43. This connector includes a contact 2 and a second insulator 3, the contact 2 and the second insulator 3 being disposed on both sides of a flexible substrate 1 across the flexible substrate 1.

A flexible conductor 4 is exposed on a front surface of the flexible substrate 1, which faces the contact 2. The contact 2 has a projection accommodating portion 5 of recess shape formed so as to face the flexible conductor 4, and the second insulator 3 is provided with a projection 6 which projects toward a back surface of the flexible substrate 1. When the projection 6 of the second insulator 3 is inserted into the projection accommodating portion 5 of the contact 2 together with the flexible substrate 1 while the flexible substrate 1 is held between the projection 6 and the projection accommodating portion 5 such that the projection 6 is covered with the flexible substrate 1, the flexible substrate 1 is pressed against an inner surface of the projection accommodating portion 5 of the contact 2 by the projection 6, and the inner surface of the projection accommodating portion 5 contacts the flexible conductor 4 exposed on the front surface of the flexible substrate 1, whereby the contact 2 is electrically connected to the flexible conductor 4.

The contact 2 passing through a through-hole for contact 8 of a first insulator 7, with which a counter connector (not illustrated) is to be fitted, and which is disposed on the front surface of the flexible substrate 1, projects from a surface of the first insulator 7 and is connected to a corresponding contact of the counter connector upon being fitted with the counter connector.

However, because the flexible conductor 4 of the flexible substrate 1 inserted into the projection accommodating portion 5 of the contact 2 together with the projection 6 of the second insulator 3 contacts the inner surface of the projection accommodating portion 5 to thereby allow the contact 2 to be electrically connected to the flexible conductor 4, the flexible conductor 4 is required to be exposed on the front surface of the flexible substrate 1, which faces a side (fitting side) on which the counter connector is to be fitted. Therefore, in a case where the flexible conductor 4 is exposed on the back surface of the flexible substrate 1, which faces the second insulator 3, i.e., the opposite side from the fitting side, there is a problem that the contact 2 cannot be electrically connected to the flexible conductor 4.

SUMMARY OF THE INVENTION

The present invention has been made to solve such problem in related art, and is to provide a connector in which a contact can be electrically connected to a flexible conductor even when a flexible substrate has the flexible conductor exposed so as to face the opposite side from the fitting side for fitting with the counter connector.

A connector according to the present invention is a connector to be connected to a flexible conductor, the connector comprising:

a first insulator having a first surface and a second surface which face in opposite directions to each other and having a through-hole for contact which penetrates from the first surface to the second surface;

a contact formed of a conductive material and held by the first insulator, the contact having a projecting portion inserted into the through-hole for contact of the first insulator; and a receiving member disposed on a side of the second surface of the first insulator and surrounding the projecting portion of the contact, wherein the flexible conductor is disposed along the second surface of the first insulator, the contact includes a contact portion formed at one end of the projecting portion and disposed on a side of the first surface of the first insulator to contact a counter connector, and an extending portion formed on another end of the projecting portion and disposed on the side of the second surface of the first insulator to extend outside of the through-hole for contact along the second surface, and a part of the flexible conductor is held between the extending portion of the contact and the receiving member to contact the extending portion, whereby the contact is electrically connected to the flexible conductor.

DETAILED DESCRIPTION OF THE INVENTION

Embodiments of the present invention will be described below on the basis of the accompanying drawings.

Embodiment 1

Figure 1:
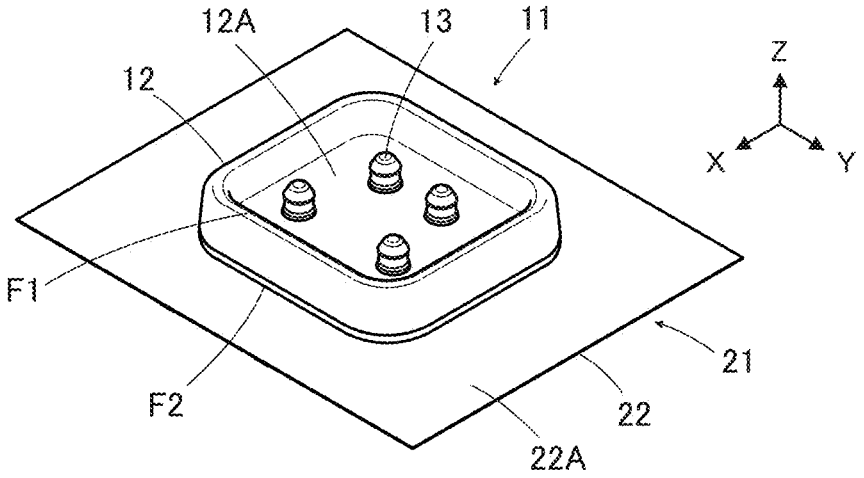
FIG. 1 is a perspective view of a connector according to Embodiment 1 of the present invention, seen from obliquely above.
Figure 2:
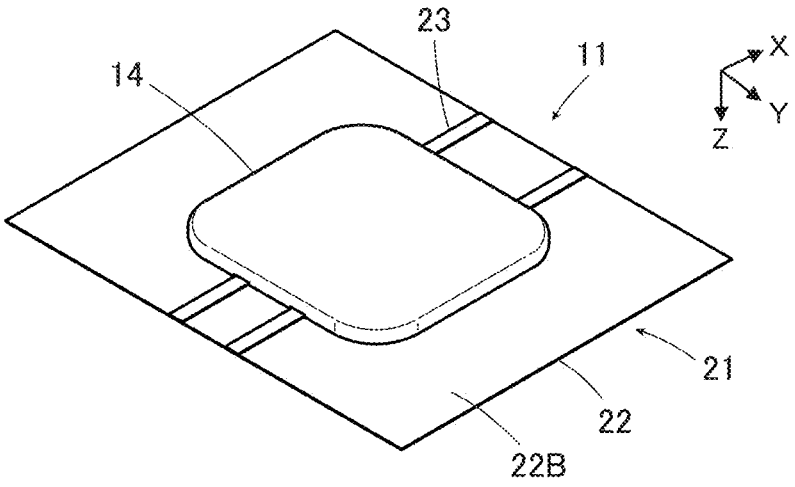
FIG. 2 is a perspective view of the connector according to Embodiment 1, seen from obliquely below.

FIG. 1 and FIG. 2 illustrate a connector 11 according to Embodiment 1. The connector 11 is, for example, used as a garment-side connector portion with which a wearable device is to be fitted, and is mounted on a flexible substrate 21.

The connector 11 includes a first insulator 12 disposed on a surface of the flexible substrate 21, four contacts 13, and a second insulator 14 which faces the first insulator 12 while the flexible substrate 21 is held between the second insulator 14 and the first insulator 12. The first insulator 12 has a first surface F1 which faces in a direction opposite to the flexible substrate 21 and a second surface F2 which faces the flexible substrate 21, a concave portion 12A is formed in the first surface F1, and the four contacts 13 each project vertically with respect to a planar bottom of the concave portion 12A within the concave portion 12A of the first insulator 12. The concave portion 12A of the first insulator 12 constitutes a counter connector accommodating portion in which part of a counter connector (not illustrated) is to be accommodated.

Here, for convenience sake, the bottom of the concave portion 12A of the first insulator 12 extends along an XY plane, and a direction in which the respective contacts 13 project are referred to as a +Z direction.

The flexible substrate 21 has a sheet-like substrate body 22 formed of an insulating material, and the substrate body 22 has a front surface 22A which faces in the +Z direction and a rear surface 22B which faces in a −Z direction. Four flexible conductors 23 are disposed so as to be exposed on the rear surface 22B of the substrate body 22. The four flexible conductors 23 independently correspond to the four contacts 13.

The flexible conductor 23 can be constituted of, for example, a band-like or yarn-like conductor, made of conductive fibers and can be also formed from a conductive paste which is applied on the rear surface 22B of the substrate body 22 through printing, or the like.

Figure 3:
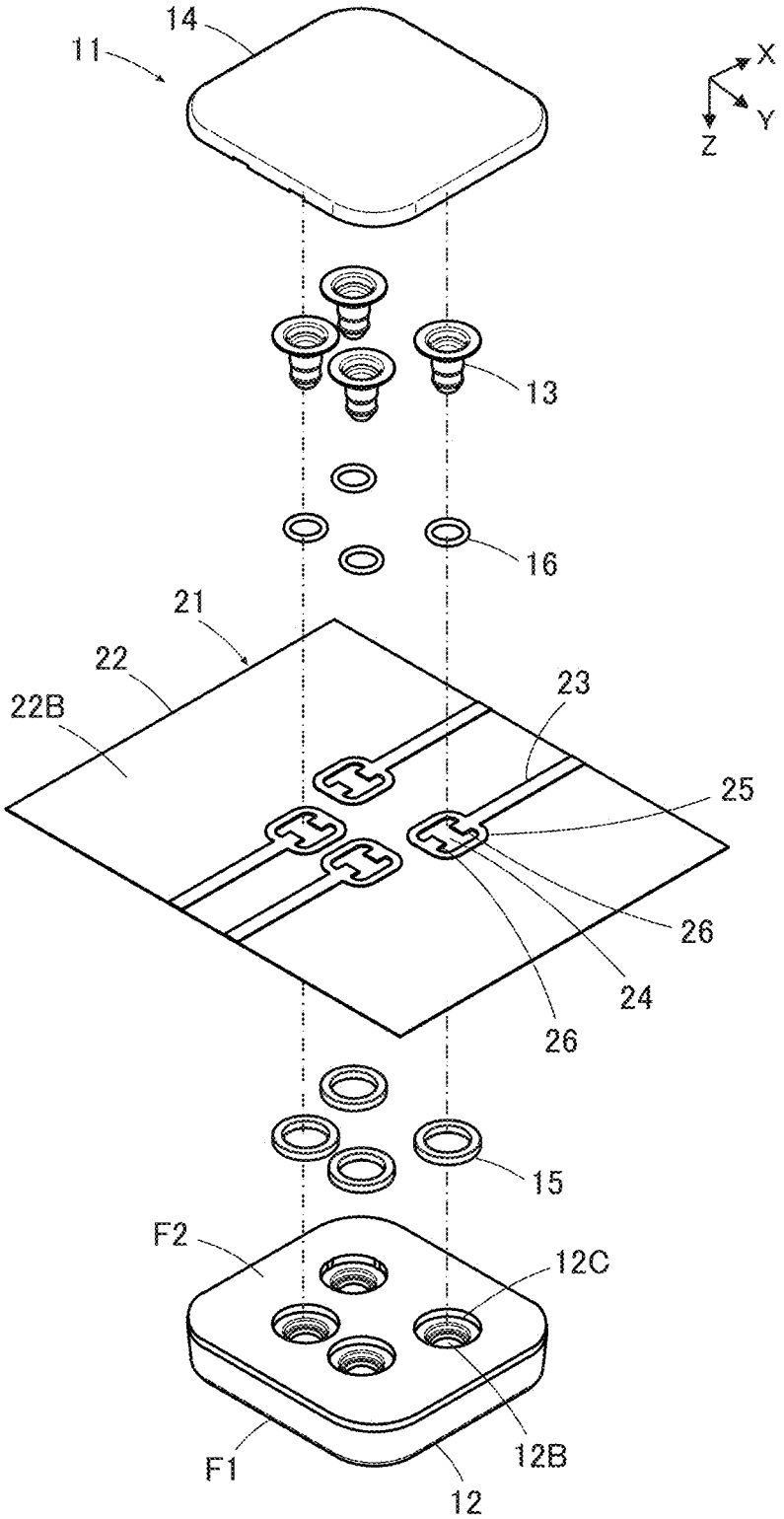
FIG. 3 is an assembly view of the connector according to Embodiment 1, seen from obliquely below.

FIG. 3 illustrates an assembly view of the connector 11. The first insulator 12 is formed of an insulating material such as an insulating resin and includes four through-holes for contact 12B penetrating from the first surface F1 to the second surface F2 and communicating with an inside of the concave portion 12A which opens toward the +Z direction. The four through-holes for contact 12B independently correspond to the four contacts 13. Further, on the second surface F2 which faces in the −Z direction of the first insulator 12, annular stepped portions 12C are separately formed at peripheral portions of the through-holes for contact 12B.

The flexible substrate 21 is disposed on the −Z direction side of the first insulator 12. The flexible substrate 21 has four openings 24 independently corresponding to the four contacts 13. On the rear surface 22B, which faces the −Z direction, of the substrate body 22 of the flexible substrate 21, the conductive portions 25 are independently formed along peripheries of the openings 24, and a pair of conductive contact portions 26 projecting to face each other in the X direction are formed within the opening 24. The pair of contact portions 26 can bend and are electrically connected to each other through the conductive portion 25, and the conductive portion 25 and the pair of contact portions 26 form part of the corresponding flexible conductor 23.

The four contacts 13 are disposed on the −Z direction side of the flexible substrate 21. The four contacts 13 are each a plug-type contact formed of a conductive material such as a metal, and, when part of the counter connector which is not illustrated is accommodated in the concave portion 12A of the first insulator 12, the four contacts 13 are connected to corresponding contacts of the counter connector.

Figure 4:
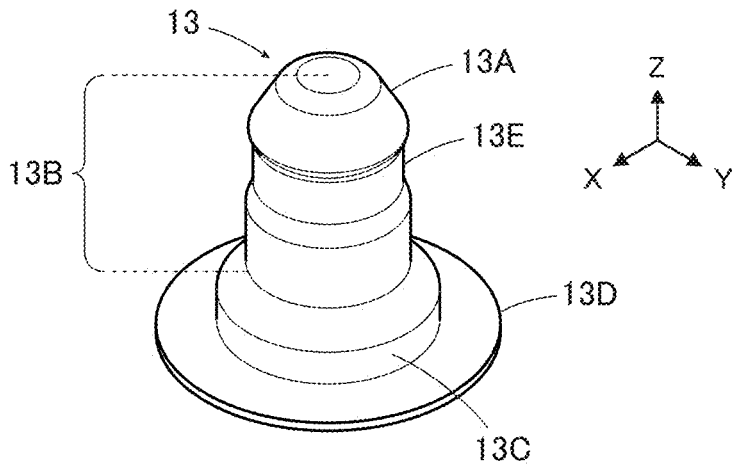
FIG. 4 is a perspective view illustrating a contact used in the connector according to Embodiment 1.

As illustrated in FIG. 4, the contact 13 has a projecting portion 13A extending in the Z direction, and a disc-shaped flange 13D formed at a −Z directional end portion of the projecting portion 13A. The projecting portion 13A includes a penetrating portion 13B which is disposed on the +Z direction side of the projecting portion 13A and which is to be inserted into the through-hole for contact 12B of the first insulator 12, and a large diameter portion 13C which is formed at the −Z directional end portion of the projecting portion 13A and which has an outer diameter larger than an outer diameter of the penetrating portion 13B, and a contact portion 13E which contacts the counter connector (not illustrated) is formed at an outer peripheral portion of the penetrating portion 13B. The large diameter portion 13C constitutes an extending portion which extends outside of the through-hole for contact 12B along the second surface F2 of the first insulator 12 when the penetrating portion 13B is inserted into the corresponding through-hole for contact 12B of the first insulator 12.

In addition, the second insulator 14 is disposed on the −Z direction side of the four contacts 13. The second insulator 14 is a planar-shaped member formed of an insulating material such as an insulating resin.

Further, four receiving members 15 are disposed between the first insulator 12 and the flexible substrate 21. Each of the receiving members 15 has a ring shape to surround the corresponding contact 13 and is provided to hold the pair of contact portions 26 of the flexible substrate 21 between the receiving member 15 and the outer peripheral surface of the large diameter portion 13C of the contact 13.

Further, the receiving member 15 has a size which allows the receiving member 15 to be fitted into the annular stepped portion 12C formed at the peripheral portion of the through-hole for contact 12B on the second surface F2 of the first insulator 12.

Four waterproof members 16 are disposed between the flexible substrate 21 and the four contacts 13. Each of the waterproof members 16 is formed of an elastic member having a ring shape and is fitted into the outer peripheral portion of the projecting portion 13A so as to surround the projecting portion 13A of the corresponding contact 13, whereby a portion between the through-hole for contact 12B of the first insulator 12 and the contact 13 is made waterproof.

The four through-holes for contact 12B of the first insulator 12, the four receiving members 15, the four openings 24 of the flexible substrate 21, the four waterproof members 16, and the four contacts 13 are positionally aligned with each other in the Z direction.

Each of the through-holes for contact 12B of the first insulator 12 has an inner diameter larger than the outer diameter of the penetrating portion 13B of the contact 13 and smaller than the outer diameter of the large diameter portion 13C, and is configured so that the penetrating portion 13B of the contact 13 can be smoothly inserted.

Figure 5:
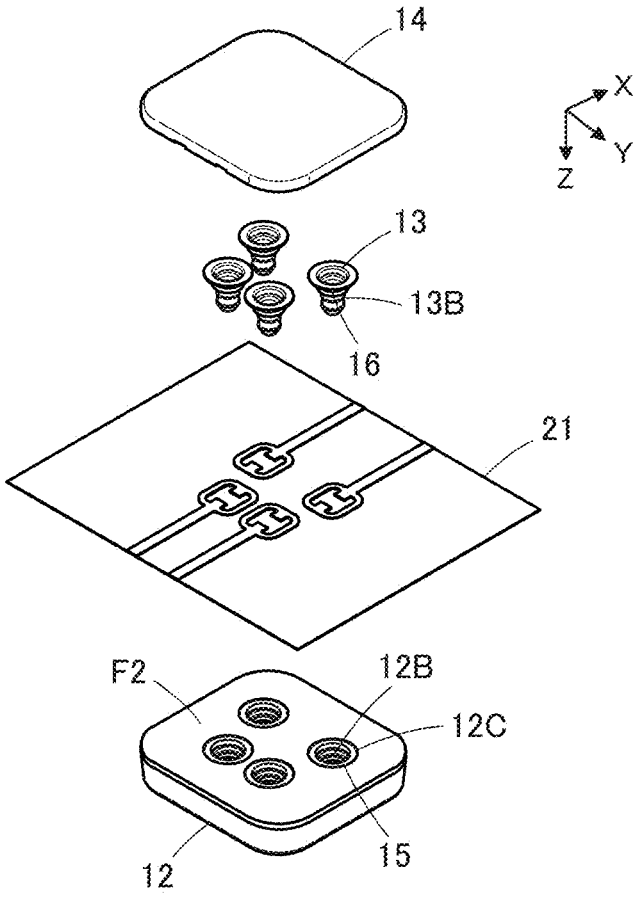
FIG. 5 is an assembly view when receiving members are fitted into a first insulator.

When the connector 11 is mounted on the flexible substrate 21, first, as illustrated in FIG. 5, the four receiving members 15 are independently fitted into the four stepped portions 12C formed so as to correspond to the four through-holes for contact 12B of the first insulator 12, and the four waterproof members 16 are fitted into outer peripheral portions of the penetrating portions 13B of the four contacts 13.

Figure 6:
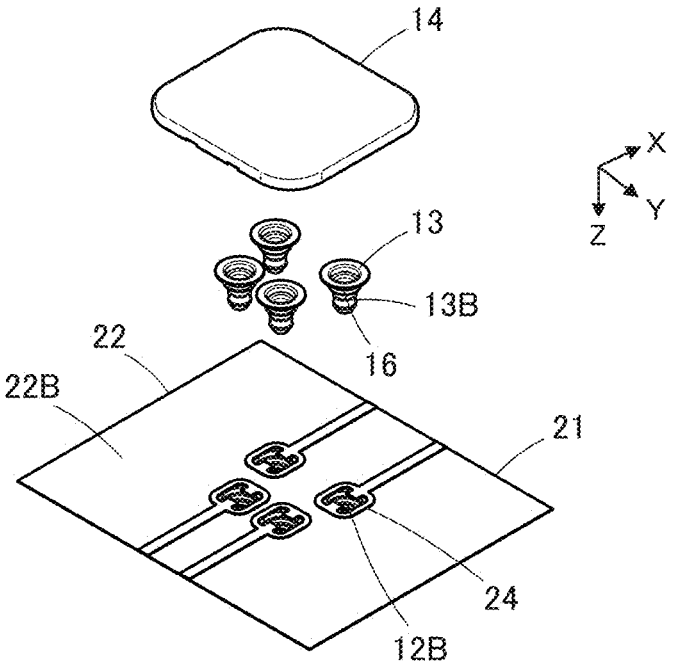
FIG. 6 is an assembly view when a flexible substrate is disposed on the first insulator.

The flexible substrate 21 is disposed on the first insulator 12 such that the front surface 22A of the substrate body 22 contacts the second surface F2 of the first insulator 12 with the receiving members 15 being fitted into the stepped portions 12C in this manner. In this event, as illustrated in FIG. 6, the four openings 24 of the flexible substrate 21 are located above the four through-holes for contact 12B of the first insulator 12.

Figure 7:
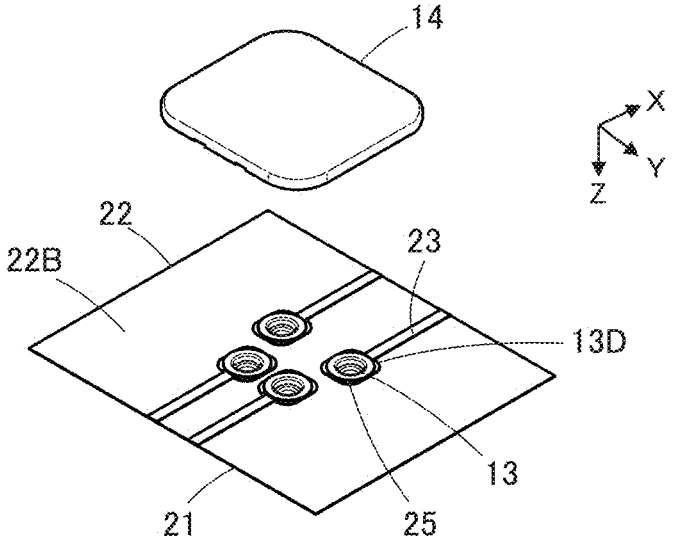
FIG. 7 is an assembly view when contacts are disposed on the flexible substrate.

In this state, the penetrating portions 13B of the four contacts 13 are inserted into the four through-holes for contact 12B of the first insulator 12 through the four openings 24 of the flexible substrate 21. In this event, as illustrated in FIG. 7, on the upper side of the rear surface 22B of the substrate body 22 of the flexible substrate 21, the flanges 13D of the contacts 13 are located above the conductive portions 25 of the flexible conductors 23.

Further, the second insulator 14 is adhered on the rear surface 22B of the substrate body 22 of the flexible substrate 21 with an adhesive. Note that the first insulator 12 is also adhered to the flexible substrate 21 with an adhesive. By this means, the connector 11 is mounted on the flexible substrate 21.

Figure 8:
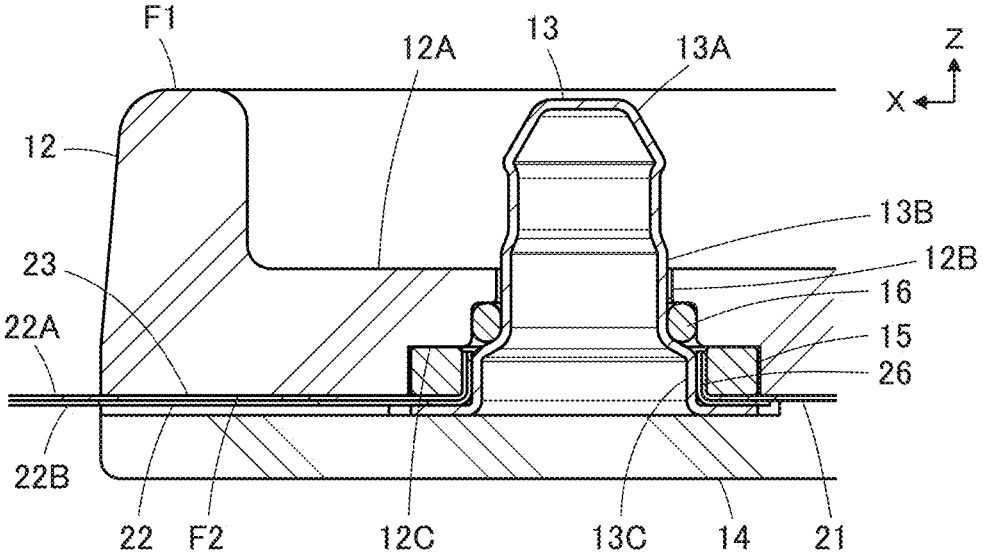
FIG. 8 is a partial cross-sectional view illustrating the connector according to Embodiment 1.

The connector 11 mounted on the flexible substrate 21 in this manner is illustrated in FIG. 8.

The flexible conductor 23 provided on the rear surface 22B of the substrate body 22 of the flexible substrate 21 is disposed along the second surface F2 of the first insulator 12, and when the penetrating portion 13B of the contact 13 is inserted into the through-hole for contact 12B of the first insulator 12, the pair of contact portions 26 which form part of the flexible conductor 23 bend in the +Z direction due to the large diameter portion 13C of the contact 13 and are held between the outer peripheral portion of the large diameter portion 13C and the inner peripheral surface of the receiving member 15. As a result, the pair of contact portions 26 contact the large diameter portion 13C of the contact 13, and the contact 13 is electrically connected to the flexible conductor 23.

Further, when the ring-shaped waterproof members 16 fitted into the outer peripheral portions of the penetrating portions 13B of the contacts 13 are independently disposed between the penetrating portions 13B of the contacts 13 and the through-holes for contact 12B of the first insulator 12, intrusion of water from the first surface F1 side of the first insulator 12 at which the concave portion 12A is formed to the second surface F2 side which contacts the flexible substrate 21 is prevented.

Because the pair of contact portions 26 are bent in the +Z direction and held between the outer peripheral surface of the large diameter portion 13C of the corresponding contact 13 and the inner peripheral surface of the receiving member 15 in this manner, even if the flexible conductors 23 are exposed on the rear surface 22B of the substrate body 22 of the flexible substrate 21 and face in the −Z direction side opposite to the +Z direction side which is the fitting side for fitting with the counter connector (not illustrated), it is possible to electrically connect the contacts 13 to the flexible conductors 23.

Note that the receiving member 15 can be formed of a conductive material such as a metal or can be formed of an insulating material such as an insulating resin. If the receiving member 15 is formed of a metal material, compared to a case where the receiving member 15 is formed of a resin, a contact pressure of the contact portion 26 of the flexible conductor 23 to the large diameter portion 13C of the contact 13 is less likely to fluctuate because a creep phenomenon is less likely to occur and because a linear expansion coefficient of the receiving member 15 is close to a linear expansion coefficient of the contact 13. Accordingly, it is possible to improve reliability of electric connection.

Figure 9:
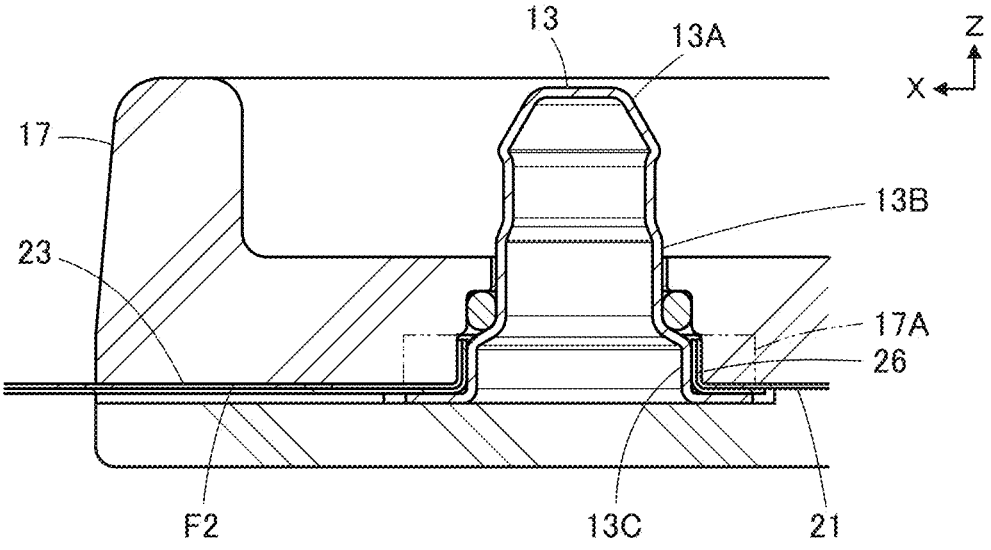
FIG. 9 is a partial cross-sectional view illustrating a connector according to a modified example of Embodiment 1.

In a case where the receiving member 15 is formed of an insulating material, the receiving member 15 can be integrally formed with the first insulator 12. In this case, for example, a first insulator 17 as illustrated in FIG. 9 is used. The first insulator 17 has annular receiving portions 17A separately formed at peripheral portions of the through-holes for contact 12B in place of the annular stepped portions 12C in the above-described first insulator 12, and the other configuration is the same as that of the first insulator 12.

Since the pair of contact portions 26 of each of the flexible conductors 23 are bent in the +Z direction and held between the outer peripheral surface of the large diameter portion 13C of the corresponding contact 13 and the inner peripheral surface of the receiving portion 17A of the first insulator 17, the contacts 13 are electrically connected to the flexible conductors 23.

In addition, while the flexible conductor 23 has the pair of contact portions 26 which contact the contact 13 in the above-described Embodiment 1, the present invention is not limited to this, and it is also possible to configure such that a single contact portion 26 is made to contact the large diameter portion 13C of the contact 13.

While FIG. 8 and FIG. 9 illustrate the contact 13 having the projecting portion 13A being hollow, it is also possible to use a solid contact 13 having the projecting portion 13A filled with a material forming the contact 13.

Embodiment 2

Figure 10:
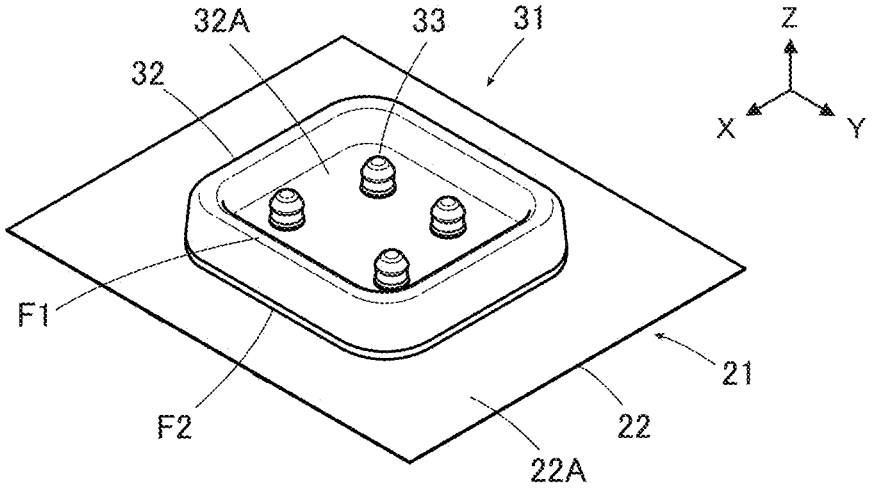
FIG. 10 is a perspective view of a connector according to Embodiment 2, seen from obliquely above.
Figure 11:
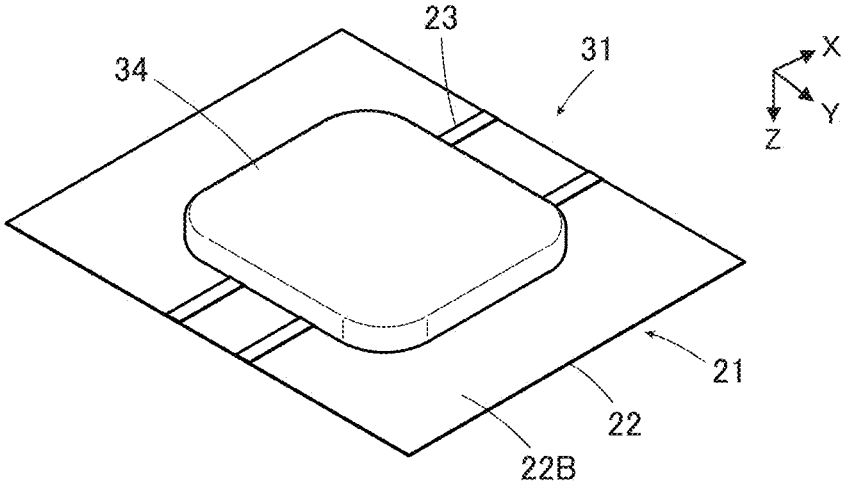
FIG. 11 is a perspective view of the connector according to Embodiment 2, seen from obliquely below.

FIG. 10 and FIG. 11 illustrate a connector 31 according to Embodiment 2. The connector 31 is used as, for example, a garment-side connector portion with which a wearable device is to be fitted in a similar manner to the connector 11 of Embodiment 1, and is mounted on the flexible substrate 21.

The connector 31 includes a first insulator 32 disposed on a surface of the flexible substrate 21, four contacts 33 and a second insulator 34 which faces the first insulator 32 with the flexible substrate 21 being sandwiched between the second insulator 34 and the first insulator 32. The first insulator 32 has a first surface F1 which faces in a direction opposite to the flexible substrate 21 and a second surface F2 which faces the flexible substrate 21, a concave portion 32A is formed in the first surface F1, and the four contacts 33 each project vertically with respect to a planar bottom of the concave portion 32A within the concave portion 32A of the first insulator 32.

Here, for convenience sake, the bottom of the concave portion 32A of the first insulator 32 extends along an XY plane, and a direction in which the respective contacts 33 project is referred to as a +Z direction.

Figure 12:
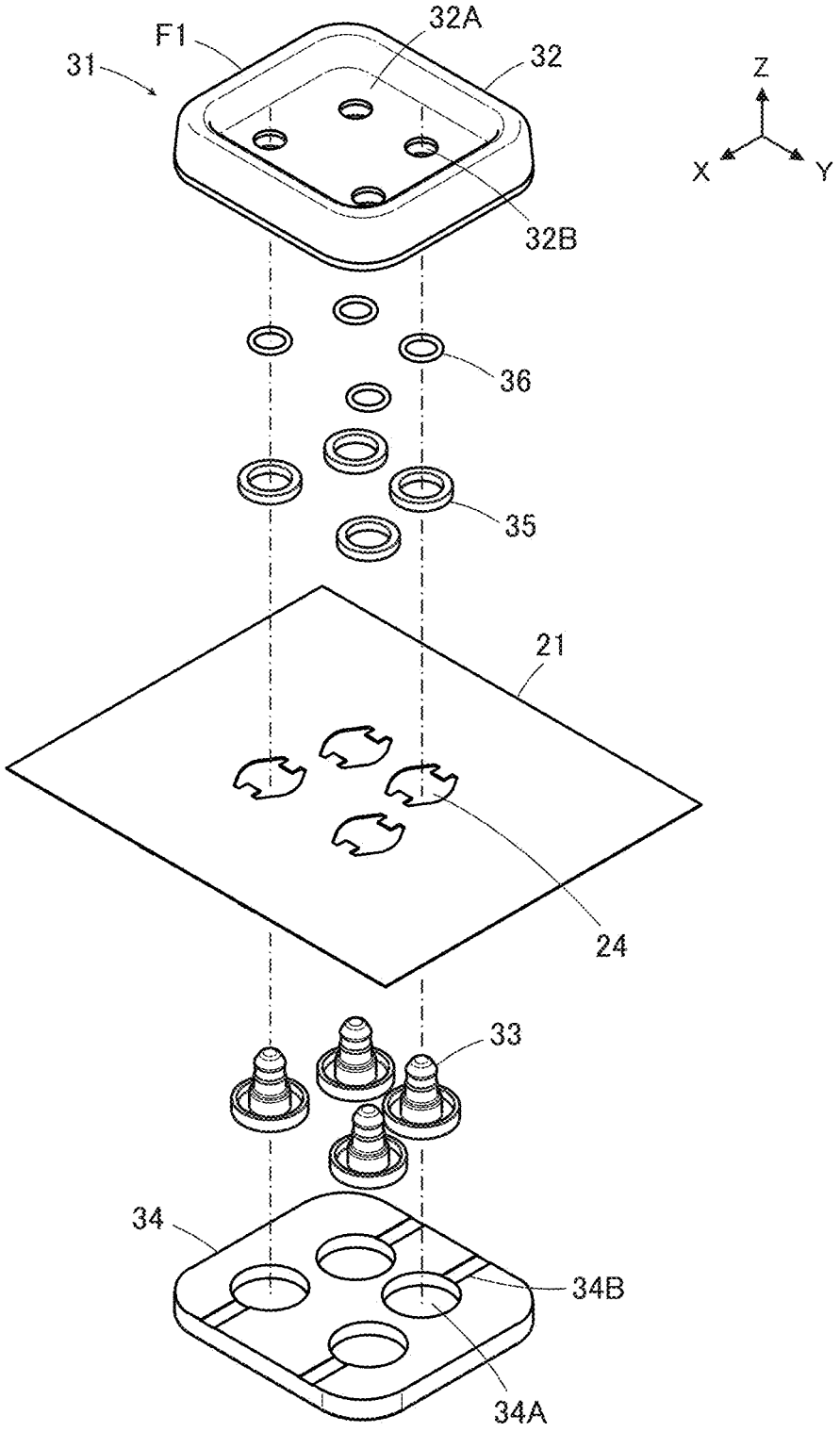
FIG. 12 is an assembly view of the connector according to Embodiment 2, seen from obliquely above.
Figure 13:
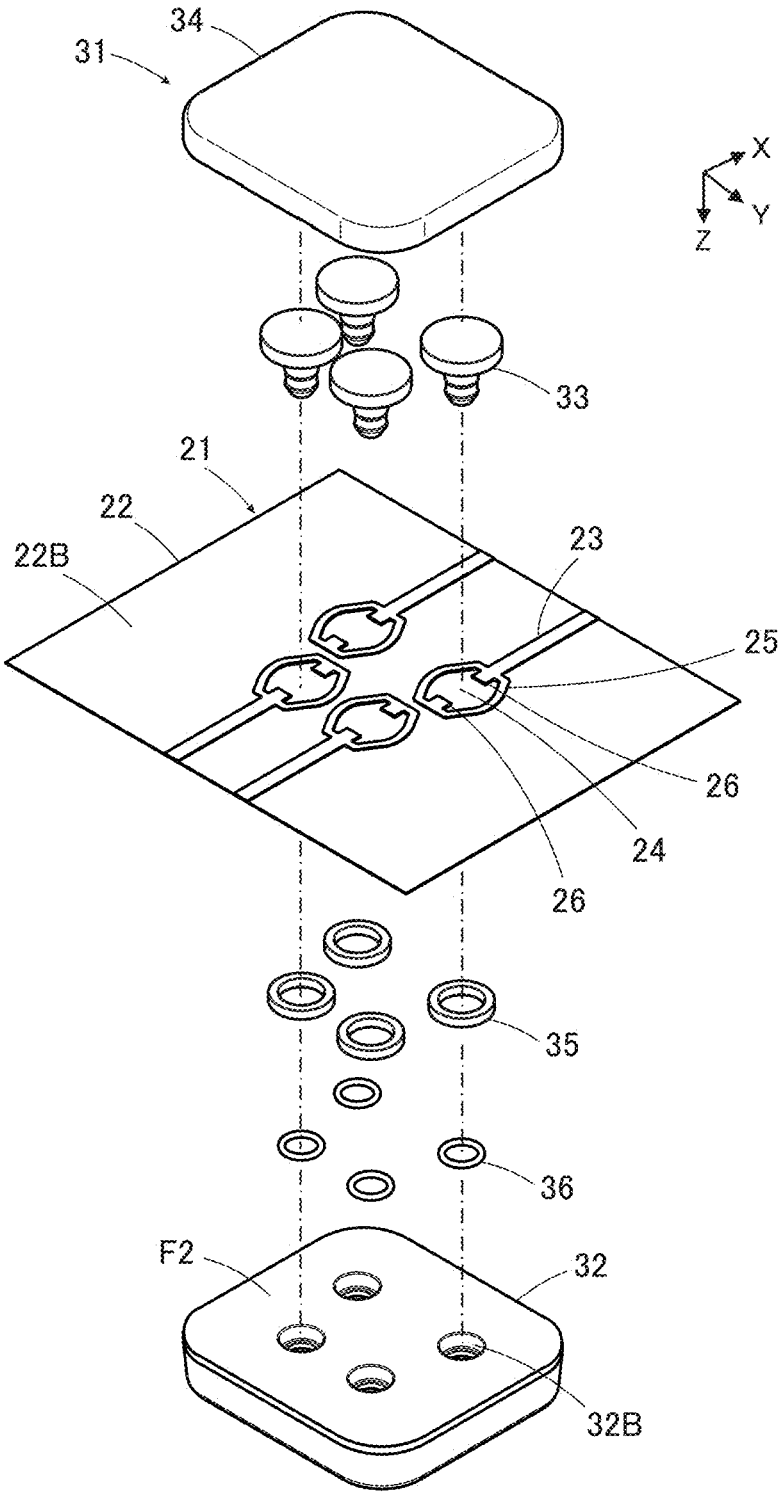
FIG. 13 is an assembly view of the connector according to Embodiment 2, seen from obliquely below.

FIGS. 12 and 13 illustrate assembly views of the connector 31. The first insulator 32 is formed of an insulating material such as an insulating resin, and includes four through-holes for contact 32B penetrating from the first surface F1 to the second surface F2 and communicating with an inside of the concave potion 32A which opens toward the +Z direction. The four through-holes for contact 32B independently correspond to the four contacts 33.

The flexible substrate 21 is disposed on the −Z direction side of the first insulator 32. The flexible substrate 21 is similar to the flexible substrate 21 in Embodiment 1 illustrated in FIG. 3 except a slight difference in a shape of the opening 24. That is, the four flexible conductors 23 are disposed to be exposed on the rear surface 22B of the substrate body 22 of the flexible substrate 21, and, further, the flexible substrate 21 has four openings 24. On the rear surface 22B, facing in the −Z direction, of the substrate body 22, the conductive portions 25 are formed along peripheries of the respective openings 24, and a pair of contact portions 26 projecting to face each other in the X direction are formed within the opening 24. The pair of contact portions 26 can bend and are electrically connected to each other through the conductive portion 25, and the conductive portion 25 and the pair of contact portions 26 form part of the corresponding flexible conductor 23.

The four contacts 33 are disposed on the −Z direction side of the flexible substrate 21. The four contacts 33 are each a plug-type contact formed of a conductive material such as a metal, and, in a case where part of the counter connector (not illustrated) is accommodated in the concave portion 32A of the first insulator 32, the four contacts 33 are connected to corresponding contacts of the counter connector.

Figure 14:
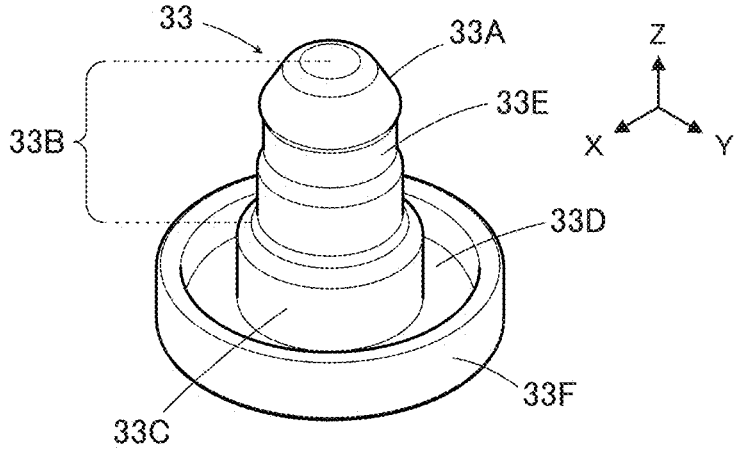
FIG. 14 is a perspective view illustrating a contact used in the connector according to Embodiment 2.

As illustrated in FIG. 14, the contact 33 has a projecting portion 33A extending in the Z direction, and a flange 33D formed at the −Z directional end portion of the projection portion 33A and extending along an XY plane. The projecting portion 33A includes a penetrating portion 33B which is disposed in the +Z direction side of the projecting portion 33A and which is to be inserted into the through-hole for contact 32B of the first insulator 32, and a large diameter portion 33C which is formed at the −Z directional end portion of the projecting portion 33A and which has an outer diameter larger than an outer diameter of the penetrating portion 33B, and a contact portion 33E which contacts the counter connector (not illustrated) is formed at an outer peripheral portion of the penetrating portion 33B. Further, the flange 33D includes a peripheral wall portion 33F which projects toward the +Z direction at an outer edge portion of the flange 33D, and constitutes an extending portion which extends outside of the through-hole for contact 32B along the second surface F2 of the first insulator 32 when the penetrating portion 33B is inserted into the corresponding through-hole for contact 32B of the first insulator 32.

Further, the second insulator 34 is disposed on the side of the −Z direction of the four contacts 33. The second insulator 34 is a planar-shaped member formed of an insulating material such as an insulating resin. On a surface, facing in the +Z direction, of the second insulator 34, provided are four concave flange accommodating portions 34A in which flanges 33D of the four contacts 33 are to be independently accommodated, and four conductor accommodating grooves 34B which are independently communicated with the four flange accommodating portions 34A and in which the corresponding flexible conductors 23 are to be accommodated.

Further, four waterproof members 36 and four receiving members 35 are disposed between the first insulator 32 and the flexible substrate 21.

The waterproof members 36 are each formed of a ring-shaped elastic member and are fitted to the outer peripheral portions of the penetrating portions 33B so as to surround the penetrating portions 33B of the corresponding contacts 33, whereby a portion between the through-holes for contact 32B of the first insulator 32 and the contacts 33 is made waterproof.

Each of the receiving members 35 has a ring shape to surround the large diameter portion 33C of the corresponding contact 33 and accommodated inside the peripheral wall portion 33F of the flange 33D, and is used to hold the pair of contact portions 26 of the flexible substrate 21 between the receiving member 35 and the inner peripheral surface of the peripheral wall portion 33F of the contact 33.

The four through-holes for contact 32B of the first insulator 32, the four waterproof members 36, the four receiving members 35, the four openings 24 of the flexible substrate 21, the four contacts 33, and the four flange accommodating portions 34A of the second insulator 34 are positionally aligned with each other in the Z direction.

Each of the through-holes for contact 32B of the first insulator 32 has an inner diameter which is larger than the outer diameter of the penetrating portion 33B of the contact 33 and which is smaller than the outer diameter of the large diameter portion 33C, and is configured so that the penetrating portion 33B of the contact 33 can be smoothly inserted.

Figure 15:
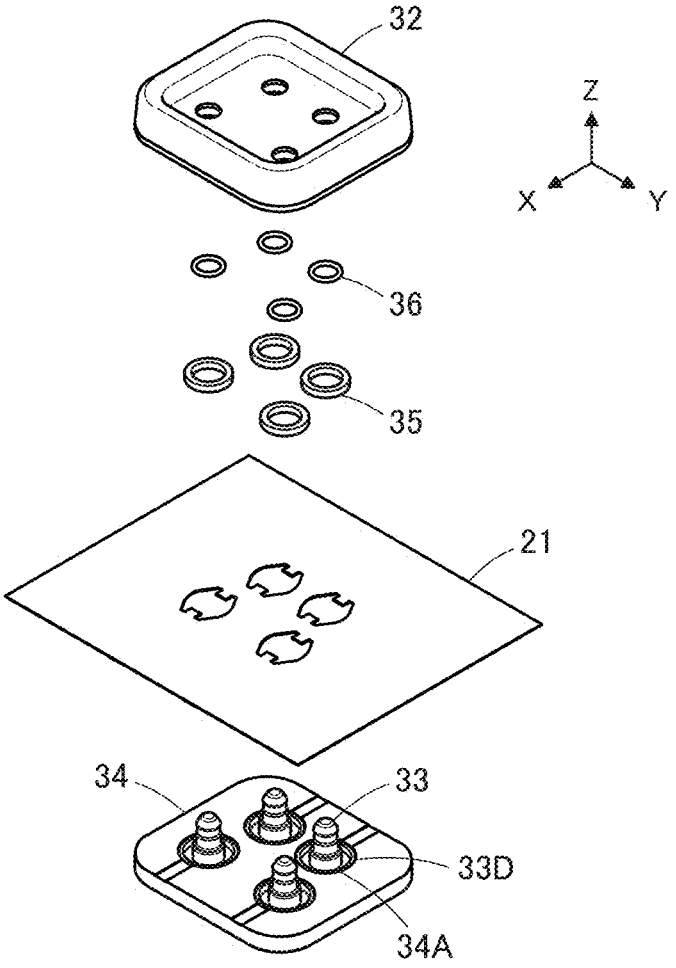
FIG. 15 is an assembly view when the contacts are disposed on a second insulator.

When the connector 31 is mounted on the flexible substrate 21, first, as illustrated in FIG. 15, the flanges 33D of the four contacts 33 are independently accommodated in the four concave flange accommodating portions 34A of the second insulator 34.

Figure 16:
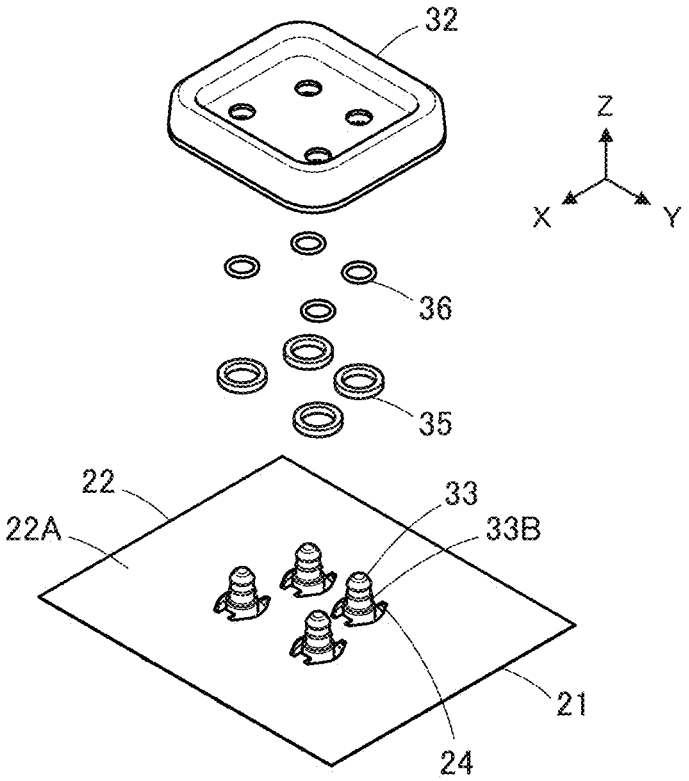
FIG. 16 is an assembly view when a flexible substrate is disposed on the second insulator.

Then, the flexible substrate 21 is disposed on the second insulator 34 such that the rear surface 22B of the substrate body 22 contacts a surface, facing in the +Z direction, of the second insulator 34. In this event, as illustrated in FIG. 16, the penetrating portions 33B of the four contacts 33 penetrate through the four openings 24 of the flexible substrate 21 and project to a side of the front surface 22A of the substrate body 22.

Figure 17:
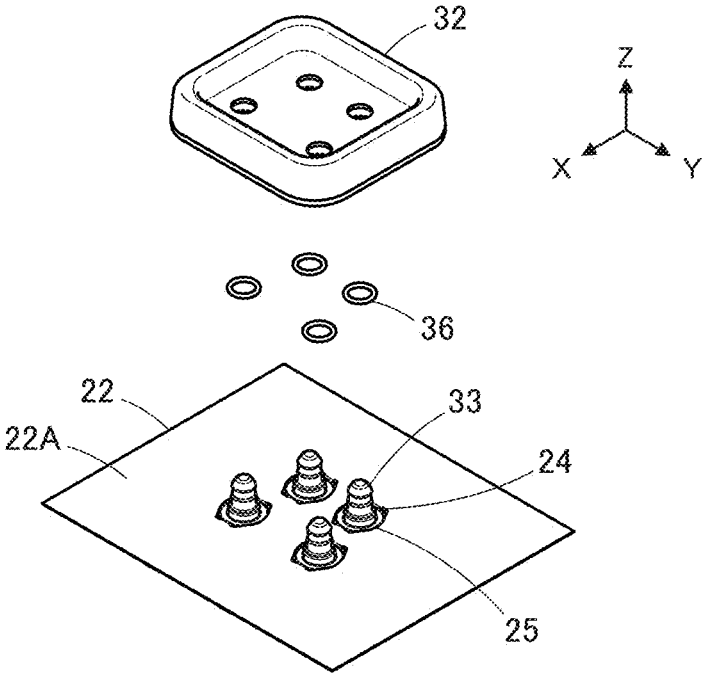
FIG. 17 is an assembly view when receiving members are fitted into the contacts.

Further, as illustrated in FIG. 17, the four receiving members 35 are moved from the +Z direction to the −Z direction and are fitted into the four contacts 33 through the four openings 24 of the flexible substrate 21. In more detail, the ring-shaped receiving members 35 are accommodated in insides of peripheral wall portions 33F of the flanges 33D while surrounding the large diameter portions 33C of the contacts 33 illustrated in FIG. 14.

Figure 18:
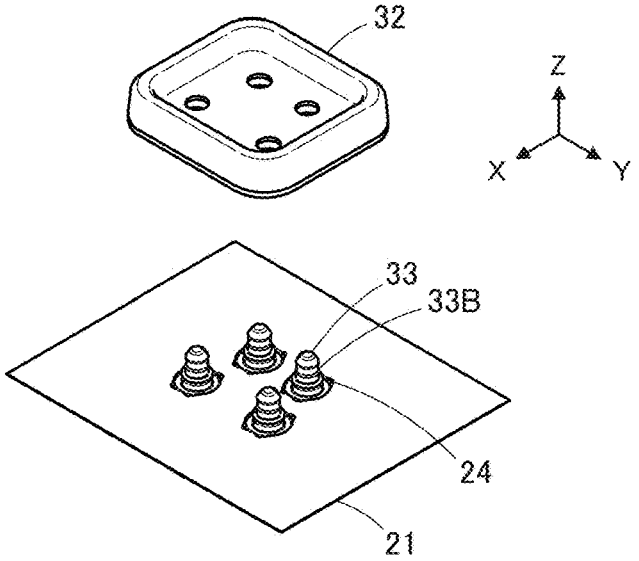
FIG. 18 is an assembly view when waterproof members are fitted into the contacts.

Then, the four waterproof members 36 are independently inserted into the four through-holes for contact 32B of the first insulator 32 from the −Z direction side. As illustrated in FIG. 18, the first insulator 32 with the waterproof members 36 being inserted into the through-holes for contact 32B in this manner is aligned on the +Z direction side of the penetrating portions 33B of the contacts 33 which penetrate through the openings 24 of the flexible substrate 21 and which project in the +Z direction.

In this state, the penetrating portions 33B of the four contacts 33 are independently inserted into the four through-holes for contact 32B of the first insulator 32.

Note that the first insulator 32 is adhered to the flexible substrate 21, and the second insulator 34 is adhered to the flexible substrate 21, with an adhesive. In this manner, the process of mounting the connector 31 on the flexible substrate 21 is completed.

Figure 19:
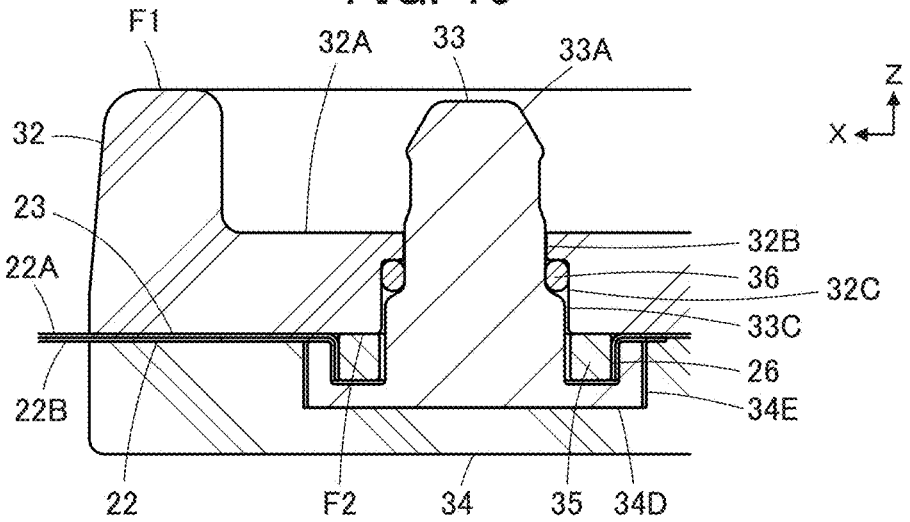
FIG. 19 is a partial cross-sectional view illustrating the connector according to Embodiment 2.

The connector 31 mounted on the flexible substrate 21 in this manner is illustrated in FIG. 19. The flexible conductor 23 formed on the rear surface 22B of the substrate body 22 of the flexible substrate 21 is disposed along the second surface F2 of the first insulator 32, and, when the ring-shaped receiving member 35 is fitted into an inside of the peripheral wall portion 33F of the flange 33D while surrounding the large diameter portion 33C of the contact 33 from the +Z direction, the pair of contact portions 26 which form part of the flexible conductor 23 bend in the −Z direction due to the receiving member 35 and is held between the inner peripheral surface of the peripheral wall portion 33F of the flange 33D and the outer peripheral surface of the receiving member 35. As a result, the pair of contact portions 26 contact the peripheral wall portion 33F of the flange 33D of the contact 13 due to the receiving member 35, and the contact 33 is electrically connected to the flexible conductor 23.

Further, as illustrated in FIG. 19, in the first insulator 32, a large diameter portion accommodating hole 32C having an inner diameter larger than an inner diameter of the through-hole for contact 32B is formed adjacent to the through-hole for contact 32B on the −Z direction side of the through-hole for contact 32B. The penetrating portion 33B of the contact 33 is inserted into the through-hole for contact 32B, and the large diameter portion 33C of the contact 33 is inserted into the large diameter portion accommodating hole 32C. Further, when the ring-shaped waterproof members 36 fitted into the penetrating portions 33B of the contacts 33 are disposed between the penetrating portions 33B of the contacts 33 and the large diameter portion accommodating hole 32C of the first insulator 32, intrusion of water from the first surface F1 side of the first insulator 32 at which the concave portion 32A is formed to the second surface F2 side which contacts the flexible substrate 21 is prevented.

Because the pair of contact portions 26 are bent in the −Z direction and held between the inner peripheral surface of the peripheral wall portion 33F of the flange 33D of the corresponding contact 33 and the outer peripheral surface of the receiving member 35 in this manner, even if the flexible conductors 23 face in the −Z direction opposite to the +Z direction side on which the counter connector (not illustrated) is to be fitted and are exposed on the rear surface 22B of the substrate body 22 of the flexible substrate 21, it is possible to electrically connect the contacts 33 to the flexible conductors 23.

Note that the receiving member 35 can be formed of a conductive material such as a metal or can be formed of an insulating material such as an insulating resin. Meanwhile, if the receiving member 35 is formed of a metal material, compared to a case where the receiving member 35 is formed of a resin, a contact pressure of the contact portion 26 of the flexible conductor 23 with respect to the peripheral wall portion 33F of the contact 33 is less likely to fluctuate because a creep phenomenon is less likely to occur and because a linear expansion coefficient of the receiving member 35 is close to a linear expansion coefficient of the contact 33. Accordingly, it is possible to improve reliability of electric connection.

Figure 20:
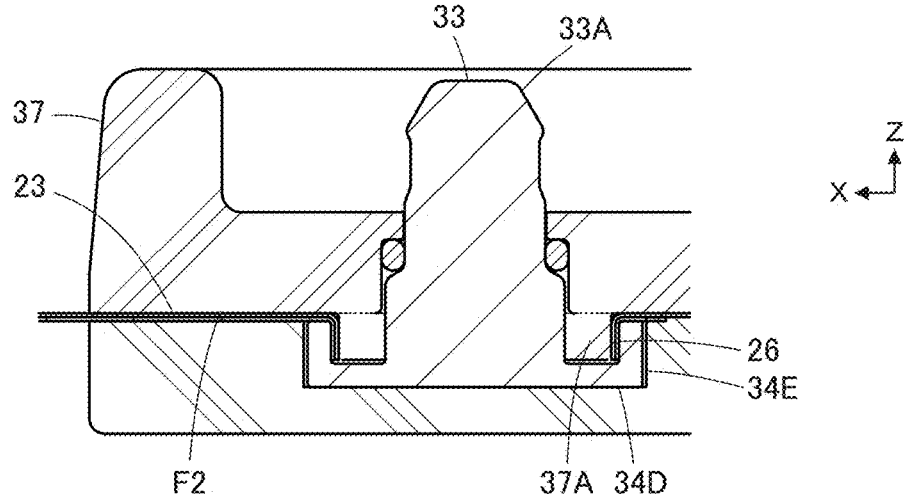
FIG. 20 is a partial cross-sectional view illustrating a connector according to a modified example of Embodiment 2.

In a case where the receiving member 35 is formed of an insulating material, the receiving member 35 can be integrally formed with the first insulator 32. In this case, for example, a first insulator 37 as illustrated in FIG. 20 is used. The first insulator 37 has annular receiving portions 37A which project toward the −Z direction from peripheral portions of the through-holes for contact 32B in the above-described first insulator 32, and the other configuration is the same as that of the first insulator 32.

When the pair of contact portions 26 of each of the flexible conductors 23 are bent in the −Z direction and held between the inner peripheral surface of the peripheral wall portion 33F of the flange 33D of the corresponding contact 33 and the outer peripheral surface of the corresponding receiving portion 37A of the first insulator 37, the contacts 33 are electrically connected to the flexible conductors 23.

Further, while, in the above-described Embodiment 2, the flexible conductor 23 has the pair of contact portions 26 which contact the contact 33, the present invention is not limited to this, and it is also possible to configure such that a single contact portion 26 is made to contact the peripheral wall portion 33F of the flange 33D of the contact 33.

While FIG. 19 and FIG. 20 illustrate a solid contact 33 filled with a material forming the contact 33, it is also possible to use a contact 33 having the projecting portion 33A being hollow.

Embodiment 3

Figure 21:
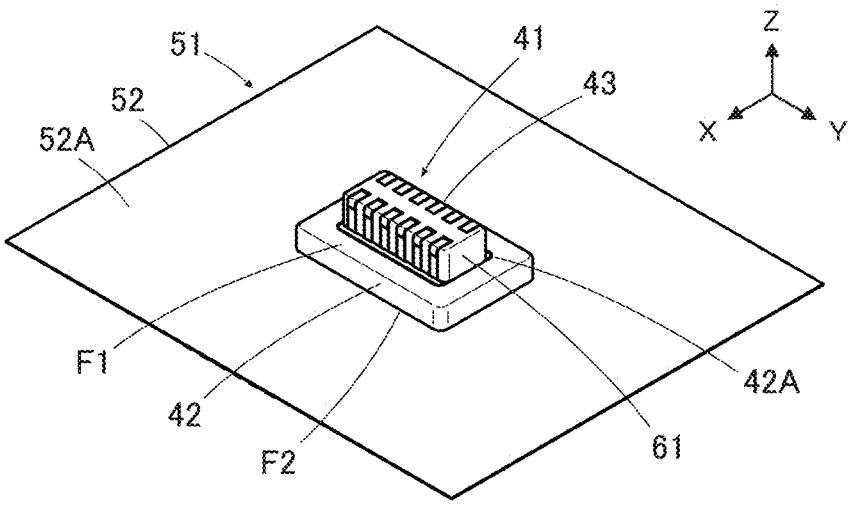
FIG. 21 is a perspective view of a connector according to Embodiment 3, seen from obliquely above.
Figure 22:
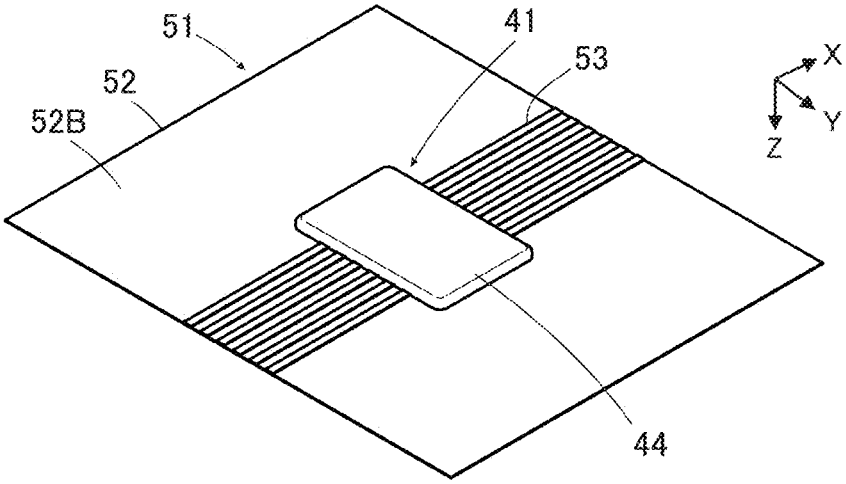
FIG. 22 is a perspective view of the connector according to Embodiment 3, seen from obliquely below.
Figure 23:
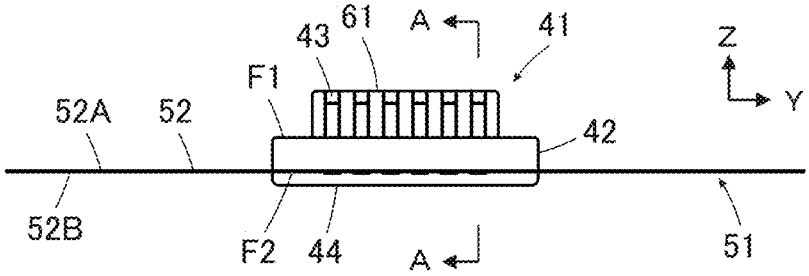
FIG. 23 is a front view of the connector according to Embodiment 3.

FIGS. 21 to 23 illustrate a connector 41 according to Embodiment 3. The connector 41 is used as, for example, a garment-side connector portion with which a wearable device is to be fitted in a similar manner to the connector 11 of Embodiment 1 and the connector 31 of Embodiment 2, and is mounted on a flexible substrate 51.

The connector 41 includes a first insulator 42 disposed on a surface of the flexible substrate 51, a contact unit 61 having a plurality of contacts 43, and a second insulator 44 which faces the first insulator 42 across the flexible substrate 51. The first insulator 42 has a first surface F1 which faces in a direction opposite to the flexible substrate 51, a second surface F2 which faces the flexible substrate 51 and one through-hole for contact 42A which penetrates from the first surface F1 to the second surface F2. The contact unit 61 is disposed to project from the first surface F1 of the first insulator 42 through the through-hole for contact 42A of the first insulator 42.

Here, for convenience sake, the first surface F1 of the first insulator 42 extends along an XY plane, and a direction in which the contact unit 61 projects is referred to as a +Z direction.

The flexible substrate 51 has a sheet-like substrate body 52 formed of an insulating material, and the substrate body 52 has a front surface 52A which faces in the +Z direction and a rear surface 52B which faces in a −Z direction. A plurality of flexible conductors 53 are disposed to be exposed on the rear surface 52B of the substrate body 52. A plurality of flexible conductors 53 are each, for example, a band-like or yarn-like conductor formed of conductive fibers, extend in the X direction and are arranged in the Y direction in parallel to each other.

Further, the flexible conductors 53 can be also formed of a conductive paste which is applied on the rear surface 52B of the substrate body 52 through printing or the like.

Figure 24:
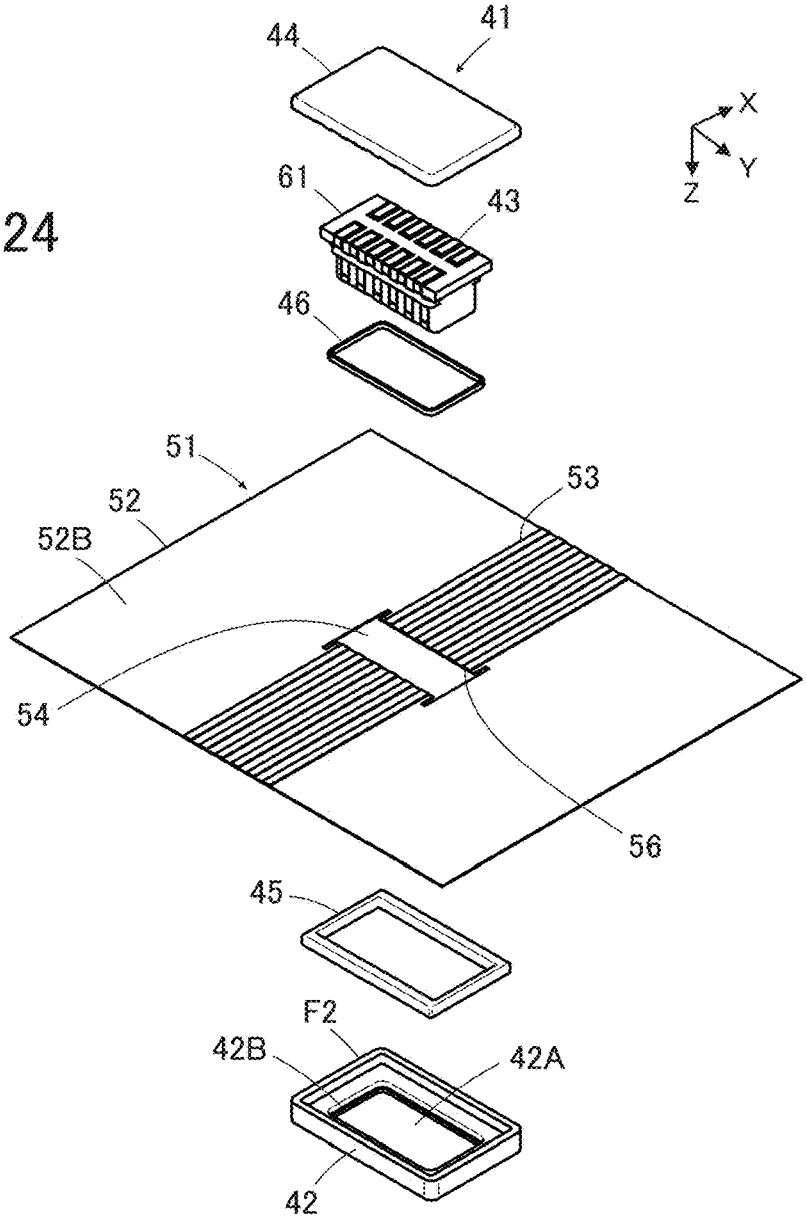
FIG. 24 is an assembly view of the connector according to Embodiment 3, seen from obliquely below.

FIG. 24 illustrates an assembly view of the connector 41. The first insulator 42 is formed of an insulating material such as an insulating resin, has a rectangular frame shape and has a stepped portion 42B formed along a periphery of the first insulator 42 on the second surface F2 side.

The flexible substrate 51 is disposed on the −Z direction side of the first insulator 42. The flexible substrate 51 has a rectangular opening 54, and, on the rear surface 52B of the substrate body 52, the plurality of flexible conductors 53 are disposed in parallel to each other on the +X direction side and the −X direction side of the opening 54. One end of each of the flexible conductors 53 extends to an inside of the opening 54 and forms a contact portion 56 which can bend.

Figure 25:
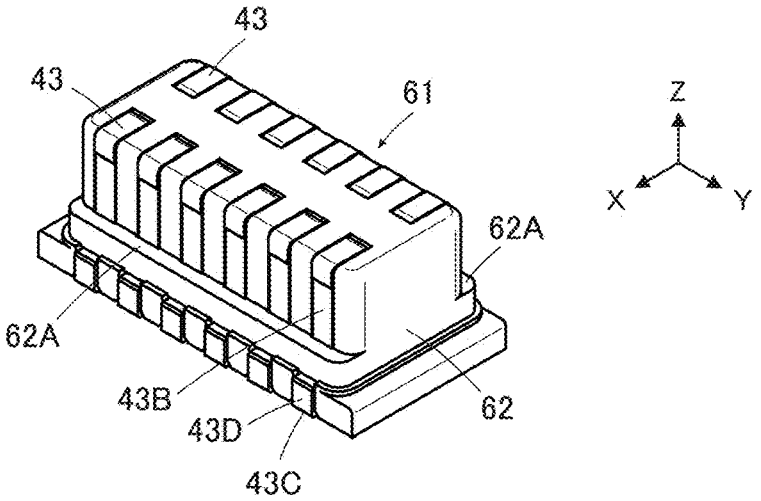
FIG. 25 is a perspective view illustrating a contact unit used in the connector according to Embodiment 3.

The contact unit 61 is disposed on the −Z direction side of the flexible substrate 51. As illustrated in FIG. 25, in the contact unit 61, a plurality of contacts 43 are arranged in two rows and held by an insulator for contact 62. The two rows of the plurality of contacts 43 are arranged adjacent to each other in the X direction, and the contacts 43 constituting each row are arranged in the Y direction.

Figure 26:
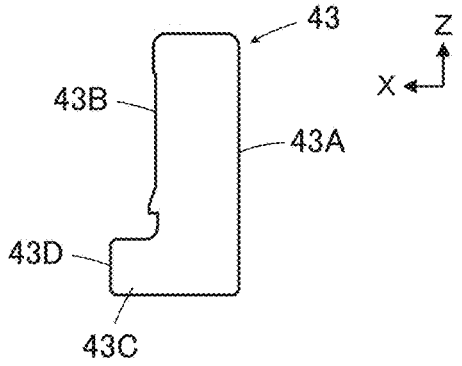
FIG. 26 is a side view illustrating a contact incorporated into the contact unit in FIG. 25.

Each of the contacts 43 is a plug-type contact formed of a conductive material such as a metal, is connected to the corresponding contact of the counter connector (not illustrated) and, as illustrated in FIG. 26, has a planar shape which extends in a substantially L shape along an XZ plane, and the contact 43 forms a projecting portion as a whole. In more detail, the contact 43 includes a penetrating portion 43A which extends in the Z direction and which is to be inserted into the through-hole for contact 42A of the first insulator 42 and an elongated portion 43C which extends in the X direction from the −Z directional end portion of the penetrating portion 43A. A contact portion 43B which contacts the counter connector (not illustrated) is formed at an end face in the X direction on the +Z directional end portion side of the penetrating portion 43A. Further, the elongated portion 43C has an end surface 43D in the X direction.

As illustrated in FIG. 25, the respective contacts 43 are held by the insulator for contact 62 such that the contact portions 43B and the end surfaces 43D in the X direction of the elongated portions 43C are exposed.

When the contact unit 61 is inserted into the through-hole for contact 42A of the first insulator 42, the penetrating portions 43A of the plurality of contacts 43 penetrate through the through-hole for contact 42A, and the elongated portions 43C of the plurality of contacts 43 constitute an extending portion which extends outside of the through-hole for contact 42A along the second surface F2 of the first insulator 42.

The insulator for contact 62 has at both end portions thereof in the X direction a pair of stepped portions 62A which extend along the Y direction on the +Z direction side of the elongated portions 43C of the plurality of contacts 43.

Further, the contact unit 61 has a shape symmetric about a YZ plane, and end surfaces 43D of the elongated portions 43C of the plurality of contacts 43 constituting one row among two rows of the contacts 43 face in the +X direction, and end surfaces 43D of elongated portions 43C of the plurality of contacts 43 constituting the other row face in the −X direction.

In FIG. 24, the second insulator 44 is disposed on the −Z direction side of the contact unit 61. The second insulator 44 is a planar-shaped member formed of an insulating material such as an insulating resin.

Further, one receiving member 45 is disposed between the first insulator 42 and the flexible substrate 51. The receiving member 45 has a rectangular frame shape surrounding end surfaces 43D of the elongated portions 43C of the plurality of contacts 43 of the contact unit 61.

Further, the receiving member 45 has a size such that the receiving member 45 is fitted into the stepped portion 42B formed along the periphery of the first insulator 42.

One waterproof member 46 is disposed between the flexible substrate 51 and the contact unit 61. The waterproof member 46 is formed of an elastic member having a rectangular frame shape, fitted on a pair of stepped portions 62A of the insulator for contact 62 so as to surround the contact unit 61, whereby a portion between the through-hole for contact 42A of the first insulator 42 and the contact unit 61 is made waterproof.

The through-hole for contact 42A of the first insulator 42, the receiving member 45, the opening 54 of the flexible substrate 51, the waterproof member 46 and the contact unit 61 are disposed to be aligned with each other in the Z direction.

Figure 27:
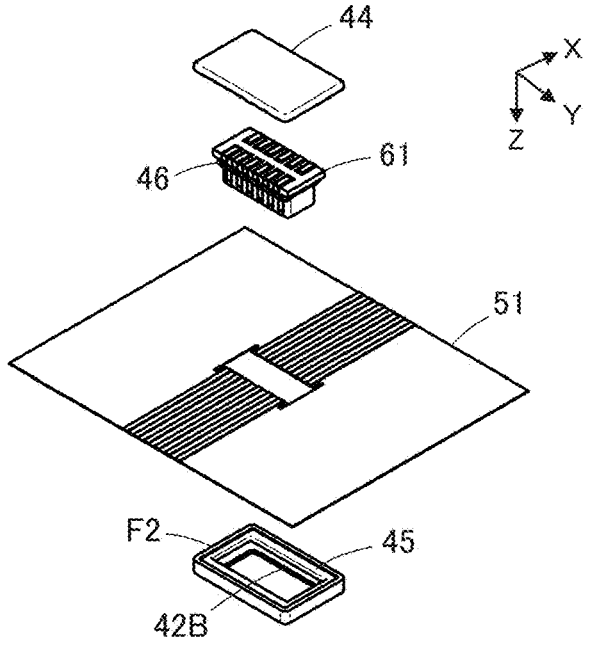
FIG. 27 is an assembly view when a receiving member is fitted into a first insulator, and a waterproof member is fitted into the contact unit.

When the connector 41 is mounted on the flexible substrate 51, first, as illustrated in FIG. 27, the receiving member 45 is fitted into the stepped portion 42B of the first insulator 42, and the waterproof member 46 is fitted into the contact unit 61.

Figure 28:
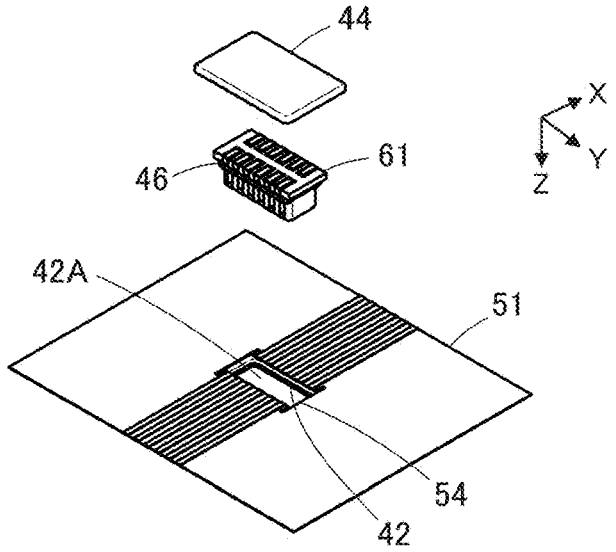
FIG. 28 is an assembly view when a flexible substrate is disposed on the first insulator.

The flexible substrate 51 is disposed on the first insulator 42 such that the front surface 52A of the substrate body 52 contacts the second surface F2 of the first insulator 42 with the receiving members 45 being fitted into the stepped portion 42B in this manner. In this event, as illustrated in FIG. 28, the opening 54 of the flexible substrate 51 is disposed on the through-hole for contact 42A of the first insulator 42.

Figure 29:
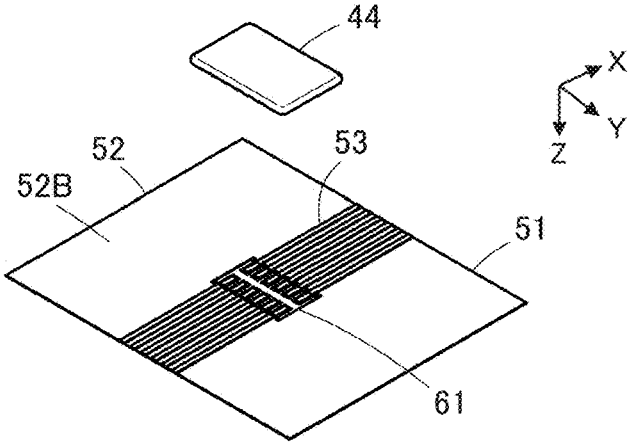
FIG. 29 is an assembly view when the contact unit is disposed on the flexible substrate.

In this state, the contact unit 61 is inserted into the through-hole for contact 42A of the first insulator 42 through the opening 54 of the flexible substrate 51 from the −Z direction. Further, as illustrated in FIG. 29, the second insulator 44 located on the −Z direction side of the contact unit 61 is adhered on the rear surface 52B of the substrate body 52 of the flexible substrate 51 with an adhesive. Note that the first insulator 42 is also adhered to the flexible substrate 51 with an adhesive. In this manner, the process of mounting the connector 41 on the flexible substrate 51 is completed.

Figure 30:
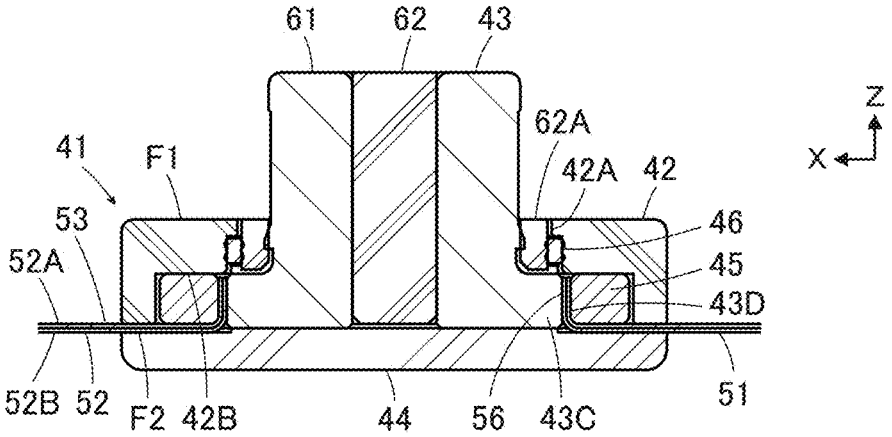
FIG. 30 is a cross-sectional view taken along line A-A in FIG. 23.

The connector 41 mounted on the flexible substrate 51 in this manner is illustrated in FIG. 30. The plurality of flexible conductors 53 formed on the rear surface 52B of the substrate body 52 of the flexible substrate 51 are disposed along the second surface F2 of the first insulator 42, and when the contact unit 61 is inserted into the through-hole for contact 42A of the first insulator 42, contact portions 56 of the plurality of flexible conductors 53 bend in the +Z direction due to the plurality of contacts 43 of the contact unit 61 and are held between the end surfaces 43D of the elongated portions 43C extending in the X direction along the second surface F2 of the first insulator 42 and the inner peripheral surface of the receiving member 45. As a result, the contact portions 56 of the plurality of flexible conductors 53 contact the end surfaces 43D of the elongated portions 43C of the corresponding contacts 43, whereby the plurality of contacts 43 are electrically connected to the plurality of flexible conductors 53.

Further, when the waterproof member 46 fitted into the outer peripheral portion of the contact unit 61 is disposed between the contact unit 61 and the through-hole for contact 42A of the first insulator 42, intrusion of water from the first surface F1 side of the first insulator 42 to the second surface F2 side is prevented.

In this manner, because the contact portions 56 of the respective flexible conductors 53 are bent in the +Z direction and are held between the end surfaces 43D of the elongated portions 43C of the corresponding contacts 43 and the inner peripheral surface of the receiving member 45, even if the plurality of flexible conductors 53 face in the −Z direction opposite to the +Z direction side on which the counter connector (not illustrated) is to be fitted and are exposed on the rear surface 52B of the substrate body 52 of the flexible substrate 51, the plurality of contacts 43 can be electrically connected to the plurality of flexible conductors 53.

According to Embodiment 3, by electrically connecting the plurality of contacts 43 of the contact unit 61 to the plurality of flexible conductors 53 of the flexible substrate 51 using one receiving member 45, a multicore connector 41 can be realized.

Note that, while the plurality of contacts 43 of the contact unit 61 are arranged in two rows in the above-described Embodiment 3, the plurality of contacts 43 may be arranged in one row.

Note that the receiving member 45 can be formed of a conductive material such as a metal or can be formed of an insulating material such as an insulating resin. If the receiving member 45 is formed of a metal material, compared to a case where the receiving member 45 is formed of a resin, a contact pressure of the contact portion 56 of the flexible conductor 53 with respect to the end surface 43D of the elongated portions 43C of the contact 43 is less likely to fluctuate because a creep phenomenon is less likely to occur and because a linear expansion coefficient of the receiving member 45 is close to a linear expansion coefficient of the contact 43. Accordingly, it is possible to improve reliability of electric connection.

In the meantime, since the plurality of flexible conductors 53 contact one receiving member 45, at least a surface of the receiving member 45 is required to have an insulating property through, for example, insulating coating.

Figure 31:
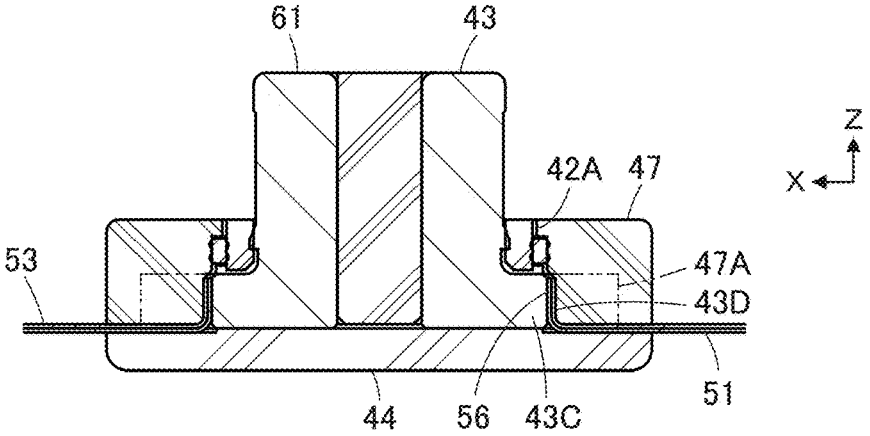
FIG. 31 is a cross-sectional view illustrating a connector according to a modified example of Embodiment 3.

In a case where the receiving member 45 is formed of an insulating material, the receiving member 45 can be integrally formed with the first insulator 42. In this case, for example, a first insulator 47 as illustrated in FIG. 31 is used. The first insulator 47 has a rectangular frame shaped receiving portion 47A formed at a peripheral portion of the through-hole for contact 42A in place of the stepped portion 42B in the above-described first insulator 42, and the other configuration is the same as those of the first insulator 42.

When the contact portions 56 of the respective flexible conductors 53 are bent in the +Z direction and held between the end surfaces 43D of the elongated portions 43C of the corresponding contacts 43 and the inner peripheral surface of the receiving portion 47A of the first insulator 47, the plurality of contacts 43 are electrically connected to the plurality of flexible conductors 53.

Embodiment 4

Figure 32:
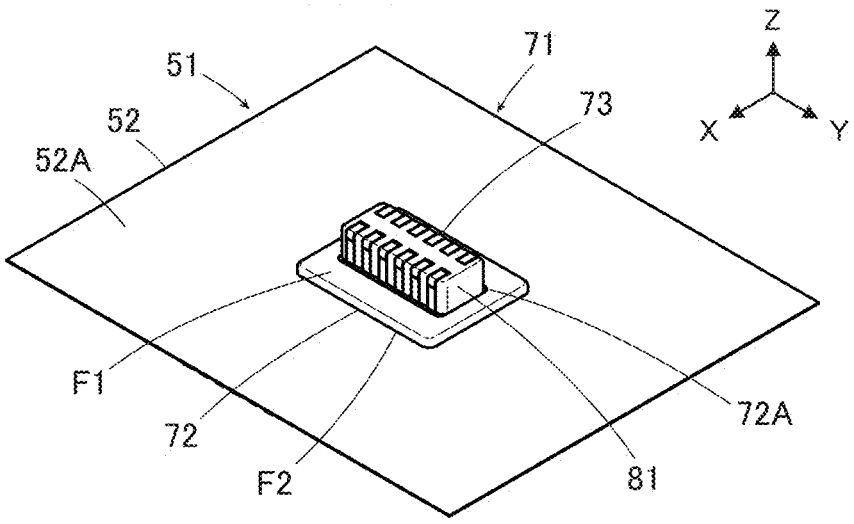
FIG. 32 is a perspective view of a connector according to Embodiment 4, seen from obliquely above.
Figure 33:
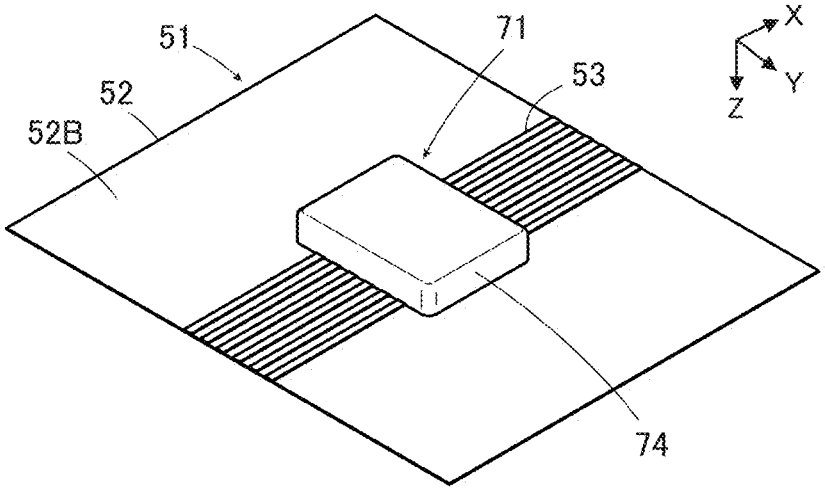
FIG. 33 is a perspective view of the connector according to Embodiment 4, seen from obliquely below.
Figure 34:
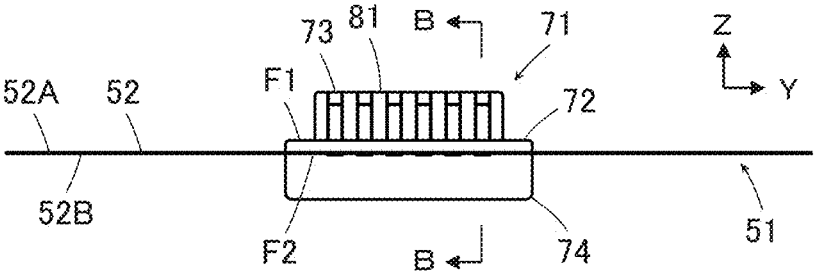
FIG. 34 is a front view of the connector according to Embodiment 4.

FIGS. 32 to 34 illustrate a connector 71 according to Embodiment 4. The connector 71 is used as, for example, a garment-side connector portion with which a wearable device is to be fitted in a similar manner to the connector 41 of Embodiment 3, and is mounted on the flexible substrate 51.

The connector 71 includes a first insulator 72 disposed on a surface of the flexible substrate 51, a contact unit 81 having a plurality of contacts 73 and a second insulator 74 which faces the first insulator 72 across the flexible substrate 51. The first insulator 72 has a first surface F1 which faces in a direction opposite to the flexible substrate 51, a second surface F2 which faces the flexible substrate 51 and one through-hole for contact 72A which penetrates from the first surface F1 to the second surface F2. The contact unit 81 is disposed to project from the first surface F1 of the first insulator 72 through the through-hole for contact 72A of the first insulator 72.

Here, for convenience sake, the first surface F1 of the first insulator 72 extends along an XY plane, and a direction in which the contact unit 81 projects is referred to as a +Z direction.

Figure 35:
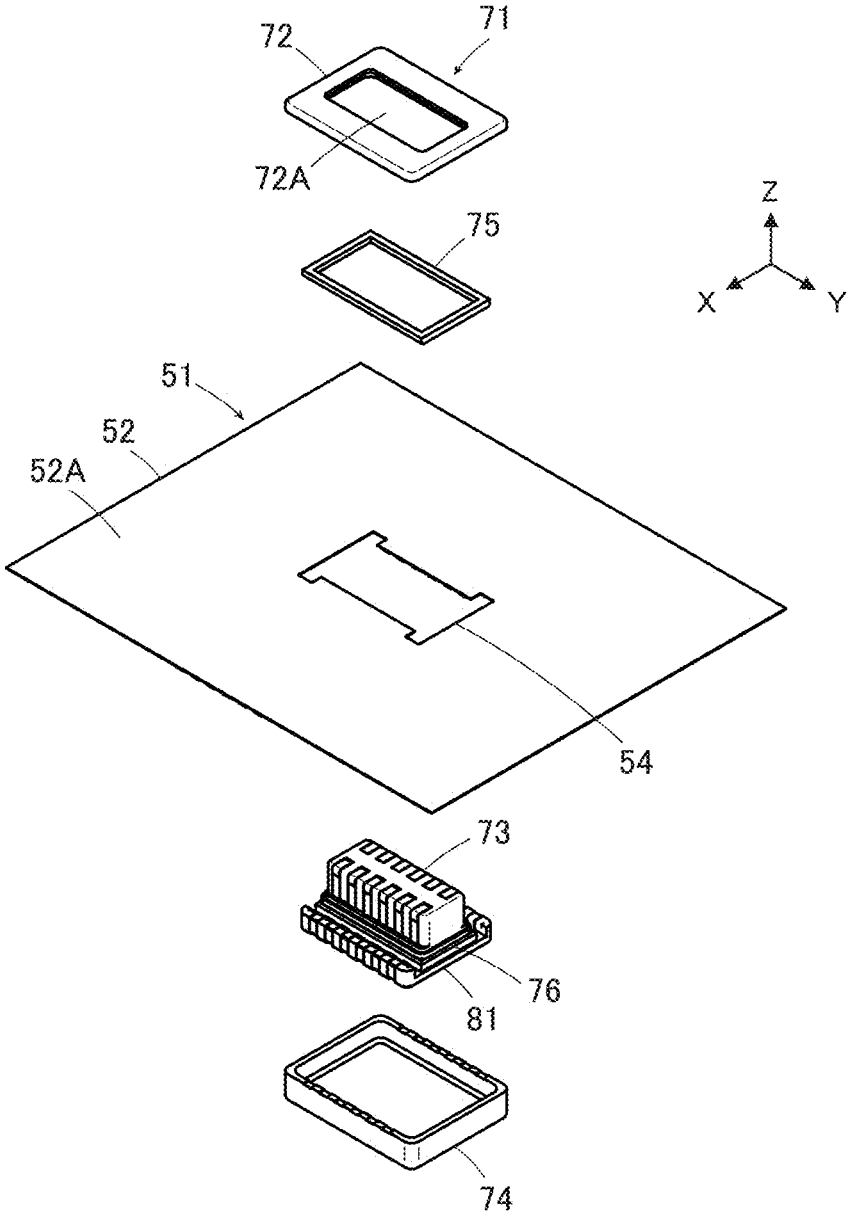
FIG. 35 is an assembly view of the connector according to Embodiment 4, seen from obliquely above.
Figure 36:
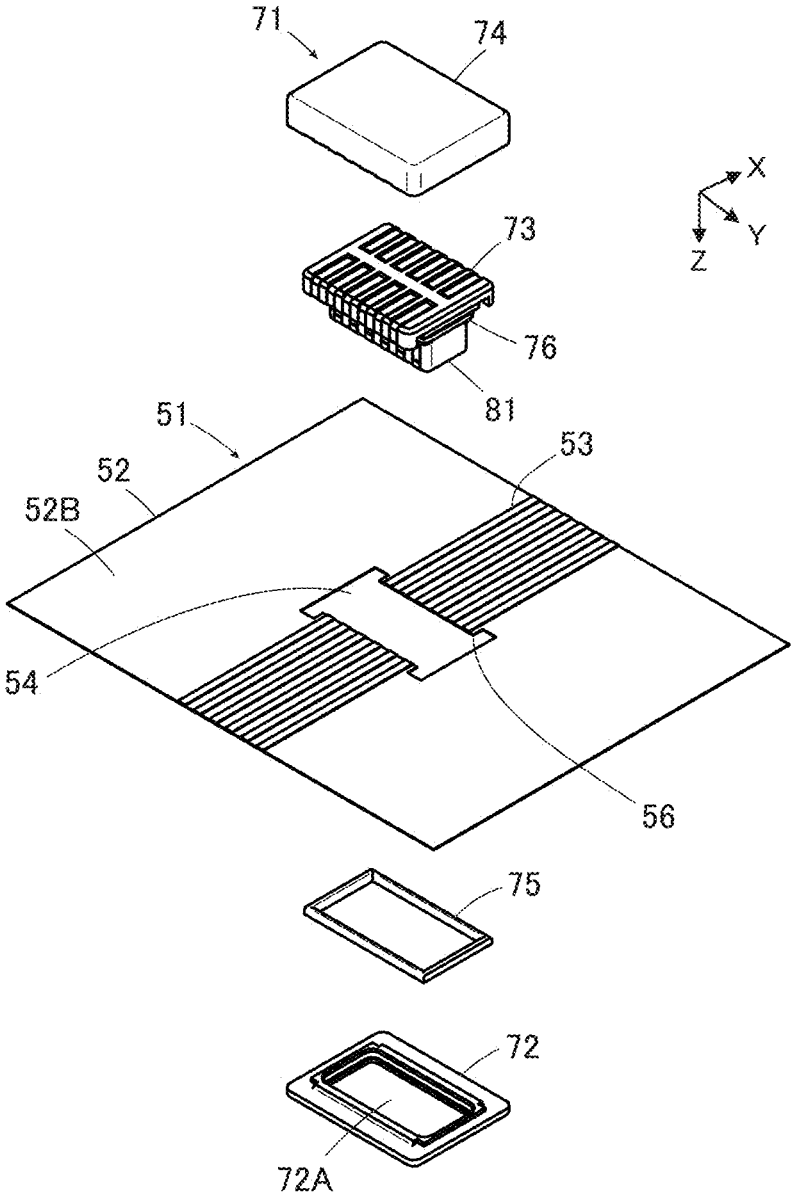
FIG. 36 is an assembly view of the connector according to Embodiment 4, seen from obliquely below.

FIGS. 35 and 36 illustrate assembly views of the connector 71. The first insulator 72 is formed of an insulating material such as an insulating resin and has a rectangular frame shape.

Figure 37:
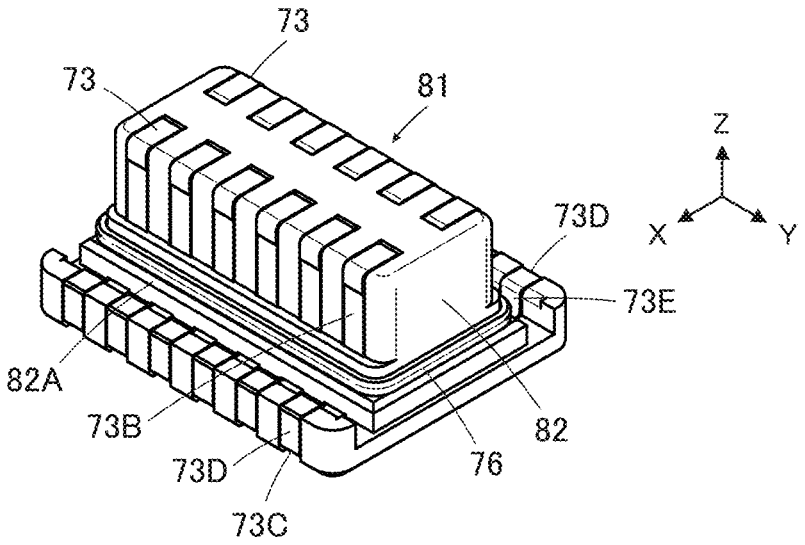
FIG. 37 is a perspective view illustrating a contact unit used in the connector according to Embodiment 4.

The flexible substrate 51 is disposed on the −Z direction side of the first insulator 72, and further, the contact unit 81 is disposed on the −Z direction side of the flexible substrate 51. As illustrated in FIG. 37, in the contact unit 81, the plurality of contacts 73 arranged in two rows and held by an insulator for contact 82. The two rows of the plurality of contacts 73 are arranged adjacent to each other in the X direction, and the contacts 73 constituting each row are arranged in the Y direction.

Figure 38:
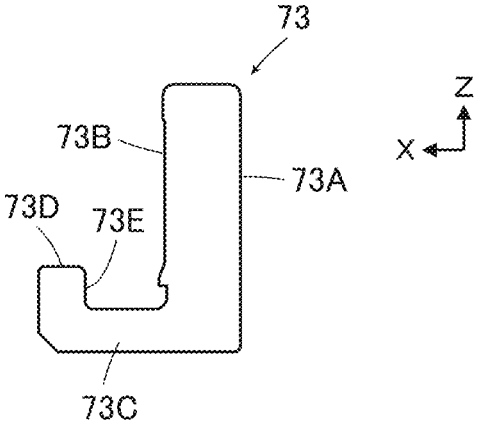
FIG. 38 is a side view illustrating a contact incorporated into the contact unit in FIG. 37.

The contacts 73 are each a plug-type contact formed of a conductive material such as a metal, are connected to corresponding contacts of the counter connector (not illustrated), and, as illustrated in FIG. 38, have a planar shape which extends in a substantially J shape along an XZ plane. In more detail, the contact 73 includes a penetrating portion 73A which extends in the Z direction and which is inserted into the through-hole for contact 72A of the first insulator 72, an elongated portion 73C which extends in the X direction from the −Z directional end portion of the penetrating portion 73A, and a rising portion 73D which rises in the Z direction in parallel to the penetrating portion 73A from a tip in the X direction of the elongated portion 73C. A contact portion 73B which contacts the counter connector (not illustrated) is formed at an end face in the X direction on the +Z directional end portion side of the penetrating portion 73A. Further, the rising portion 73D has an inner surface 73E facing the penetrating portion 73A. Note that the penetrating portion 73A forms a projecting portion.

As illustrated in FIG. 37, the respective contacts 73 are held by the insulator for contact 82 such that the contact portions 73B and the rising portions 73D including the inner surfaces 73E are exposed.

The elongated portions 73C and the rising portions 73D of the plurality of contacts 73 constitute an extending portion which extends outside of the through-hole for contact 72A along the second surface F2 of the first insulator 72 when the contact unit 81 is inserted into the through-hole for contact 72A of the first insulator 72.

The insulator for contact 82 has at both end portions thereof in the X direction stepped portions 82A which extend along the Y direction on the +Z direction side of the elongated portions 73C of the plurality of contacts 73.

Further, the contact unit 81 has a shape which is symmetric about a YZ plane, and, among the contacts 73 in two rows, the inner surfaces 73E of the rising portions 73D of the contacts 73 constituting one row and the inner surfaces 73E of the rising portions 73D of the contacts 73 constituting the other row separately face the stepped portions 82A in the X direction.

One waterproof member 76 is disposed on the stepped portions 82A of the insulator for contact 82. The waterproof member 76 is formed of an elastic member having a rectangular frame shape and fitted on the stepped portions 82A of the insulator for contact 82 so as to surround the contact unit 81, whereby a portion between the through-hole for contact 72A of the first insulator 72 and the contact unit 81 is made waterproof.

In FIG. 35 and FIG. 36, the second insulator 74 is disposed on the −Z direction side of the contact unit 81. The second insulator 74 is formed of an insulating material such as an insulating resin and has a box shape opening in the +Z direction.

Further, one receiving member 75 is disposed between the first insulator 72 and the flexible substrate 51. The receiving member 75 has a rectangular frame shape surrounding the stepped portions 82A of the contact unit 81 and is provided to hold the contact portions 56 of the plurality of flexible conductors 53 between the receiving member 75 and the inner surfaces 73E of the rising portions 73D of the plurality of contacts 73.

Further, the receiving member 75 has a size such that the receiving member 75 is fitted into insides of the inner surfaces 73E of the rising portions 73D of the plurality of contacts 73 arranged in two rows in the contact unit 81.

The through-hole for contact 72A of the first insulator 72, the receiving member 75, the opening 54 of the flexible substrate 51, the contact unit 81 and the second insulator 74 are disposed to be aligned with each other in the Z direction.

Figure 39:
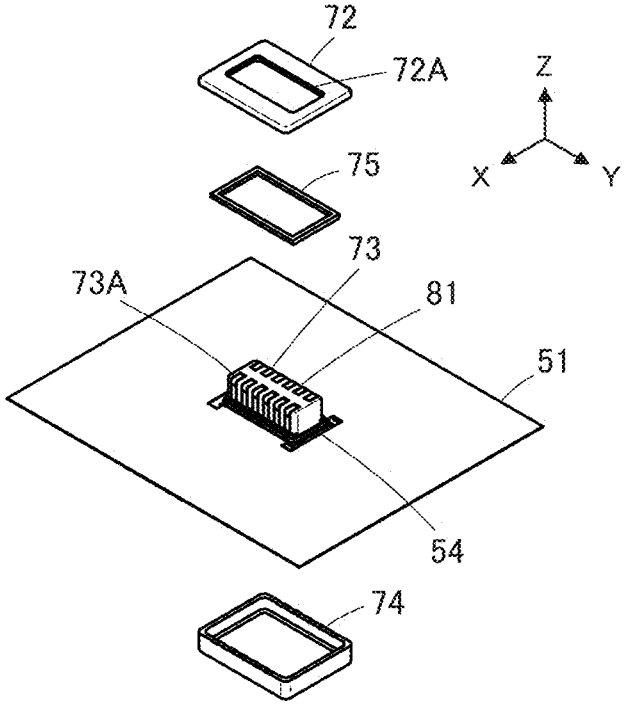
FIG. 39 is an assembly view when a contact unit is disposed on the flexible substrate.

When the connector 71 is mounted on the flexible substrate 51, first, the flexible substrate 51 is disposed on the contact unit 81 such that the rear surface 52B of the substrate body 52 contacts surfaces, facing in the +Z direction, of the rising portions 73D of the plurality of contacts 73 of the contact unit 81. In this event, as illustrated in FIG. 39, the penetrating portions 73A of the plurality of contacts 73 of the contact unit 81 project in the +Z direction from the opening 54 of the flexible substrate 51.

Figure 40:
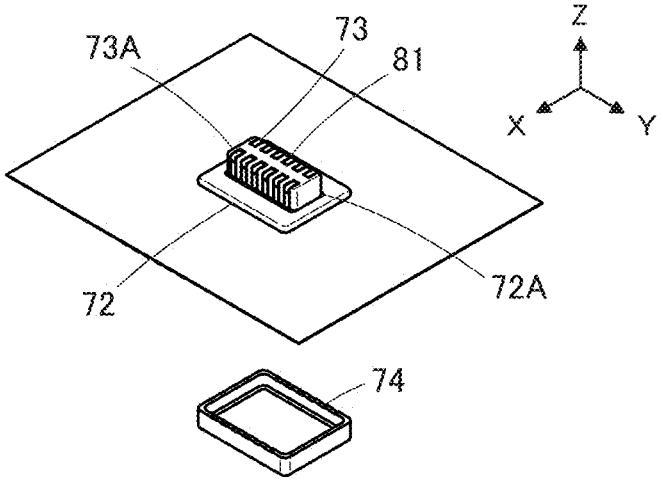
FIG. 40 is an assembly view in a stage in which a first insulator and a receiving member are fitted into the contact unit.

Then, the receiving member 75 is moved toward the contact unit 81 from the +Z direction and is fitted into insides of the inner surfaces 73E of the rising portions 73D of the plurality of contacts 73 arranged in two rows of the contact unit 81. Thereafter, the first insulator 72 is disposed on the flexible substrate 51 from the +Z direction. In this event, as illustrated in FIG. 40, the penetrating portions 73A of the plurality of contacts 73 of the contact unit 81 project on the +Z direction side through the through-hole for contact 72A of the first insulator 72.

Further, the second insulator 74 located on the −Z direction side of the flexible substrate 51 is adhered on the rear surface 52B of the substrate body 52 of the flexible substrate 51 with an adhesive. Note that the first insulator 72 is also adhered to the flexible substrate 51 with an adhesive. In this manner, the process of mounting the connector 71 on the flexible substrate 51 is completed.

Figure 41:
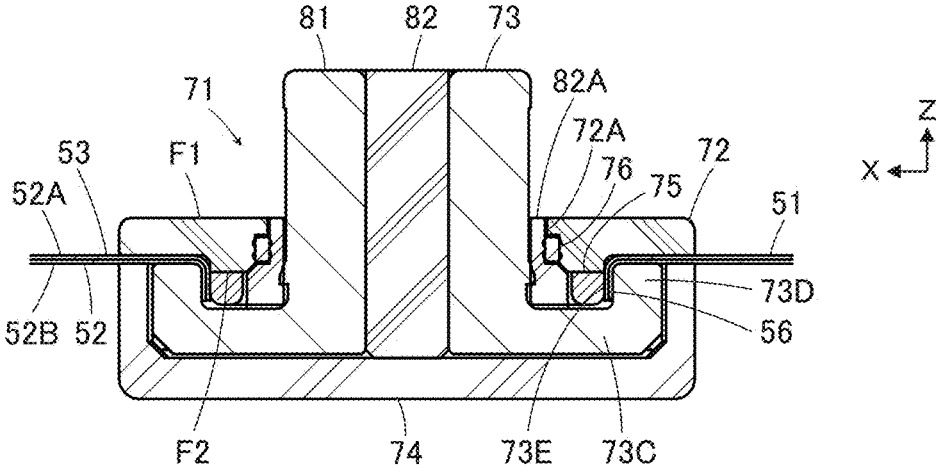
FIG. 41 is a cross-sectional view taken along line B-B in FIG. 34.

The connector 71 mounted on the flexible substrate 51 in this manner is illustrated in FIG. 41. The plurality of flexible conductors 53 formed on the rear surface 52B of the substrate body 52 of the flexible substrate 51 are disposed along the second surface F2 of the first insulator 72, and when the receiving member 75 is fitted into insides of the inner surfaces 73E of the rising portions 73D of the plurality of contacts 73, the contact portions 56 of the plurality of flexible conductors 53 bend in the −Z direction due to the receiving member 75 and are held between the inner surfaces 73E of the rising portions 73D of the plurality of contacts 73 and the outer peripheral surface of the receiving member 75. As a result, the contact portions 56 of the plurality of flexible conductors 53 contact the inner surfaces 73E of the rising portions 73D of the corresponding contacts 73, whereby the plurality of contacts 73 are electrically connected to the plurality of flexible conductors 53.

Further, when the waterproof member 76 fitted into the outer peripheral portion of the contact unit 81 is disposed between the contact unit 81 and the through-hole for contact 72A of the first insulator 72, intrusion of water from the first surface F1 side of the first insulator 72 to the second surface F2 side is prevented.

In this manner, because the contact portions 56 of the respective flexible conductors 53 are bent in the −Z direction and held between the inner surfaces 73E of the rising portions 73D of the corresponding contacts 73 and the outer peripheral surface of the receiving member 75, even if the plurality of flexible conductors 53 face in the −Z direction opposite to the +Z direction side on which the counter connector (not illustrated) is to be fitted and are exposed on the rear surface 52B of the substrate body 52 of the flexible substrate 51, the plurality of contacts 73 can be electrically connected to the plurality of flexible conductors 53.

According to Embodiment 4, by electrically connecting the plurality of contacts 73 of the contact unit 81 to the plurality of flexible conductors 53 of the flexible substrate 51 using one receiving member 75, a multicore connector 71 can be realized.

Note that, while the plurality of contacts 73 of the contact unit 81 are arranged in two rows in the above-described Embodiment 4, the plurality of contacts 73 may be arranged in one row.

Note that the receiving member 75 can be formed of a conductive material such as a metal or can be formed of an insulating material such as an insulating resin. If the receiving member 75 is formed of a metal material, compared to a case where the receiving member 75 is formed of a resin, a contact pressure of the contact portion 56 of the flexible conductor 53 with respect to the inner surface 73E of the rising portion 73D of the contact 73 is less likely to fluctuate because a creep phenomenon is less likely to occur and because a linear expansion coefficient of the receiving member 75 is close to a linear expansion coefficient of the contact 73. Accordingly, it is possible to improve reliability of electric connection.

However, since the plurality of flexible conductors 53 contact one receiving member 75, at least a surface of the receiving member 75 is required to have an insulating property through, for example, insulating coating.

Figure 42:
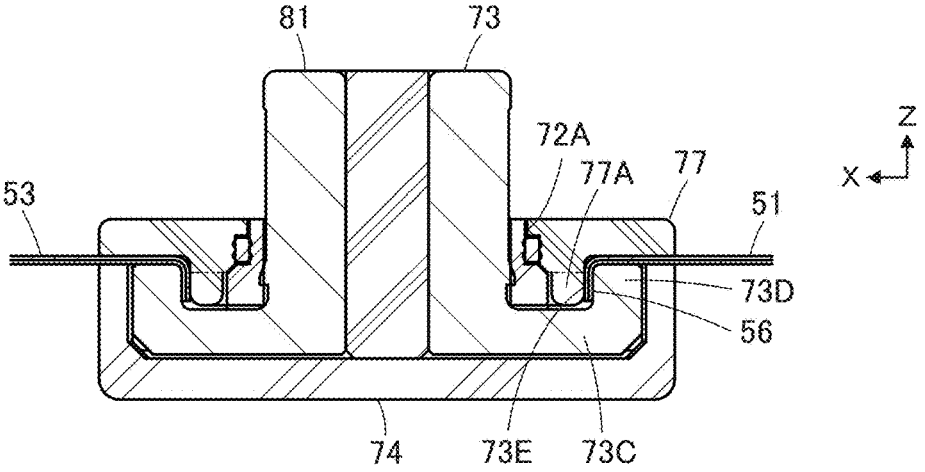
FIG. 42 is a cross-sectional view illustrating a connector according to a modified example of Embodiment 4.
Figure 43:
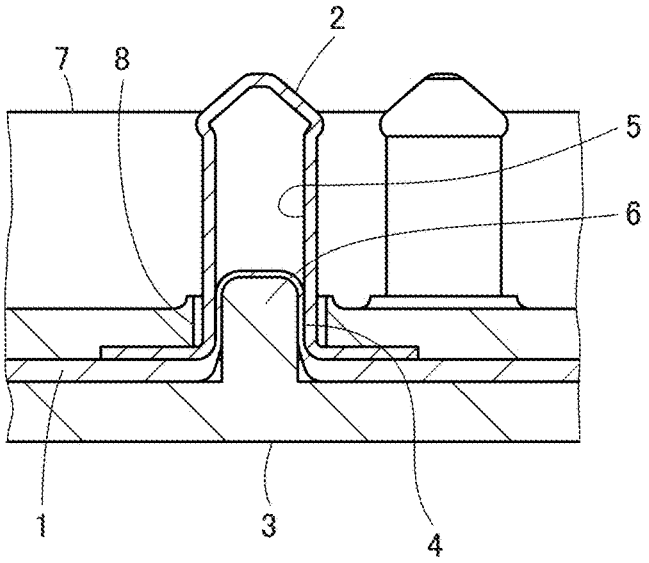
FIG. 43 PRIOR ART
FIG. 43 is a cross-sectional view illustrating a contact, a projection, and a flexible substrate in a conventional connector.

In a case where the receiving member 75 is formed of an insulating material, the receiving member 75 can be integrally formed with the first insulator 72. In this case, for example, a first insulator 77 as illustrated in FIG. 42 is used. The first insulator 77 has an annular receiving portion 77A which projects toward the −Z direction from a peripheral portion of the through-hole for contact 72A in the above-described first insulator 72, and the other configuration is the same as that of the first insulator 72.

When the contact portions 56 of the respective flexible conductors 53 are bent in the −Z direction and held between the inner surfaces 73E of the rising portions 73D of the corresponding contacts 73 and the inner peripheral surface of the receiving portion 77A of the first insulator 77, the plurality of contacts 73 are electrically connected to the plurality of flexible conductors 53.

While, in the above-described Embodiments 1 to 4, the connector 11, 31, 41, 71 is mounted on the flexible substrate 21, 51 in which the flexible conductors 23, 53 are supported by the insulating substrate body 22, 52, the present invention is not limited to this. The connector can be configured such that the contacts 13, 33, 43, 73 are electrically connected to the flexible conductors 23, 53 which are independently disposed along the second surface F2 of the first insulator 12, 17, 32, 37, 42, 47, 72, 77 without being supported by the insulating substrate body in a similar manner.

Further, while the plug-type contacts 13, 33, 43, 73 are used in the above-described Embodiments 1 to 4, the present invention is not limited to this, and the connector can be configured such that receptacle type contacts are electrically connected to the flexible conductors 23, 53 in a similar manner.

What is claimed is:

1. A connector to be connected to a flexible conductor, the connector comprising:

a first insulator having a first surface and a second surface facing in opposite directions to each other, and a through-hole for contact penetrating from the first surface to the second surface;

a contact formed of a conductive material and held by the first insulator, the contact having a projecting portion inserted into the through-hole for contact of the first insulator; and a receiving member disposed on a side of the second surface of the first insulator and surrounding the projecting portion of the contact, wherein the flexible conductor is disposed along the second surface of the first insulator, the contact includes a contact portion formed at one end of the projecting portion and disposed on a side of the first surface of the first insulator to contact a counter connector, and an extending portion formed on another end of the projecting portion and disposed on the side of the second surface of the first insulator to extend outside of the through-hole for contact along the second surface, the extending portion has a contact surface extending in a projecting direction of the projecting portion, the receiving member has a receiving surface extending in the projecting direction of the projecting portion, and a part of the flexible conductor is held between the contact surface of the extending portion of the contact and the receiving surface of the receiving member to contact the contact surface of the extending portion, whereby the contact is electrically connected to the flexible conductor.

2. The connector according to claim 1, wherein the projecting portion of the contact includes a penetrating portion inserted in the through-hole for contact of the first insulator, and a large diameter portion having an outer diameter larger than an outer diameter of the penetrating portion, the extending portion of the contact is constituted of the large diameter portion, and the flexible conductor is held between the contact surface consisting of an outer peripheral surface of the large diameter portion and the receiving surface consisting of an inner peripheral surface of the receiving member.

3. The connector according to claim 1, wherein the extending portion of the contact is constituted of a flange extending along the second surface of the first insulator, including a peripheral wall portion formed at an outer edge portion of the flange, and projecting toward the second surface of the first insulator, and the flexible conductor is held between the contact surface consisting of an inner peripheral surface of the peripheral wall portion of the flange and the receiving surface consisting of an outer peripheral surface of the receiving member.

4. The connector according to claim 1, further comprising a waterproof member disposed between the projecting portion of the contact and the through-hole for contact of the first insulator.

5. The connector according to claim 1, further comprising a contact unit having a plurality of the contacts aligned and held by an insulator for contact, wherein the contact unit is inserted into the through-hole for contact of the first insulator, the receiving member surrounds the projecting portions of the plurality of contacts of the contact unit, and a plurality of the flexible conductors are separately held between the extending portions of the plurality of the contacts of the contact unit and the receiving member, whereby the plurality of the contacts are electrically connected to the plurality of the flexible conductors.

6. The connector according to claim 5, wherein the extending portions of the plurality of the contacts of the contact unit are constituted of elongated portions extending along the second surface of the first insulator, and the plurality of flexible conductors are held between the contact surface consisting of end surfaces of the elongated portions of the plurality of the contacts and the receiving surface consisting of an inner peripheral surface of the receiving member.

7. The connector according to claim 5, wherein the extending portions of the plurality of the contacts of the contact unit include elongated portions extending along the second surface of the first insulator and rising portions rising toward the second surface of the first insulator from tips of the elongated portions, and the plurality of flexible conductors are held between the contact surface consisting of inner surfaces of the rising portions of the plurality of the contacts facing the projecting portions, and the receiving surface consisting of an outer peripheral surface of the receiving member.

8. The connector according to claim 5, further comprising a waterproof member disposed between the contact unit and the through-hole for contact of the first insulator.

9. The connector according to claim 1, wherein the receiving member is integrally formed with the first insulator.

10. The connector according to claim 1, further comprising a second insulator facing the second surface of the first insulator across the flexible conductor.

11. The connector according to claim 1, wherein the first insulator includes a counter connector accommodating portion accommodating a part of the counter connector.

12. The connector according to claim 1, wherein the flexible conductor is disposed so as to be exposed on a surface of an insulating substrate body, and the flexible conductor is disposed along the second surface of the first insulator such that a rear surface of the insulating substrate body faces the second surface of the first insulator.

13. The connector according to claim 1, wherein the flexible conductor is independently disposed along the second surface of the first insulator.

14. The connector according to claim 1, wherein the contact is a plug-type contact.

* * * * *